US009714150B2

(12) United States Patent
Miyake et al.

(10) Patent No.: US 9,714,150 B2
(45) Date of Patent: Jul. 25, 2017

(54) SHEET CONVEYING APPARATUS WITH ESCAPE SECTION THAT DOES NOT CONVEY SHEET TO POST-PROCESSING APPARATUS, AND POST-PROCESSING SYSTEM WITH ESCAPE SECTION THAT DOES NOT CONVEY SHEET TO POST-PROCESSING UNIT

(71) Applicant: CANON KABUSHIKI KAISHA, Tokyo (JP)

(72) Inventors: Toshiyuki Miyake, Abiko (JP); Akinobu Nishikata, Abiko (JP); Satoru Yamamoto, Noda (JP); Takashi Yokoya, Kashiwa (JP); Katsuya Nakama, Nagareyama (JP); Koji Yumoto, Toride (JP); Riki Fukuhara, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 8 days.

(21) Appl. No.: 14/693,040

(22) Filed: Apr. 22, 2015

(65) Prior Publication Data

US 2015/0307310 A1 Oct. 29, 2015

(30) Foreign Application Priority Data

Apr. 28, 2014 (JP) ..... 2014-092722

(51) Int. Cl.
*B65H 37/04* (2006.01)
*B65H 29/58* (2006.01)
(Continued)

(52) U.S. Cl.
CPC ..... *B65H 29/58* (2013.01); *B42C 19/02* (2013.01); *B42C 19/08* (2013.01); *B65H 43/06* (2013.01); *G03G 15/6582* (2013.01); *B65H 2404/632* (2013.01); *B65H 2511/30* (2013.01); *B65H 2513/42* (2013.01); *B65H 2801/27* (2013.01); *G03G 2215/00818* (2013.01); *G03G 2215/0129* (2013.01)

(58) Field of Classification Search
CPC ..... B65H 37/04; B65H 29/58; B65H 43/06; B42C 19/02; B42C 19/08; G03G 15/6582
(Continued)

(56) References Cited

U.S. PATENT DOCUMENTS 4,444,491 A * 4/1984 Rinehart ..... B42C 1/12 227/155
4,523,750 A * 6/1985 Hubler ..... B25C 5/1689 227/120
(Continued)

*Primary Examiner* — Patrick Mackey
(74) *Attorney, Agent, or Firm* — Rossi, Kimms & McDowell LLP

(57) ABSTRACT

A sheet conveying apparatus that restricts conveyance of sheets to a post-processing apparatus which has become incapable of continuing a post-processing operation. The sheet conveying apparatus is communicably connected to the post-processing apparatus that performs post-processing on a sheet bundle formed by sheets. The sheet conveying apparatus includes a conveying unit for conveying sheets and an escape tray for receiving conveyed sheets which are not conveyed to the post-processing apparatus. A value corresponding to the number of sheet bundles formed by conveyed sheets is counted. A CPU circuit section determines based on communication with the post-processing apparatus whether or not the post-processing operation can be continued thereby. When it is determined that the post-processing operation cannot be continued, the CPU circuit section switches the sheet conveying destination from the post-processing apparatus to the escape tray, based on the counted value.

15 Claims, 19 Drawing Sheets

(51) Int. Cl.

| | |
|---|---|
| ***B65H 43/06*** | (2006.01) |
| ***G03G 15/00*** | (2006.01) |
| ***B42C 19/02*** | (2006.01) |
| ***B42C 19/08*** | (2006.01) |

(58) Field of Classification Search
USPC ..... 270/58.09
See application file for complete search history.

(56) References Cited

U.S. PATENT DOCUMENTS 5,221,953 A * 6/1993 Higaki ..... B42C 1/125 270/58.08
5,241,355 A * 8/1993 Yamashita ..... G03G 15/6541 270/58.07
5,269,503 A * 12/1993 Hiroi ..... B27F 7/21 227/2
5,385,340 A * 1/1995 Hiroi ..... B42C 1/12 270/58.13
5,697,039 A * 12/1997 Nishimori ..... G03G 15/6541 399/16
5,971,383 A * 10/1999 Horikawa ..... B42C 1/125 270/58.08
6,357,737 B1 * 3/2002 Yoshida ..... H04N 1/00567 270/58.08
8,027,044 B2 * 9/2011 Sato ..... B65H 31/24 270/58.01
8,132,994 B2 3/2012 Okada et al.

* cited by examiner

*FIG. 10A*

| SIGNAL NAME | DIRECTION OF TRANSMITTING SIGNAL |
|---|---|
| OPERATION START SIGNAL 601 | CPU CIRCUIT SECTION 390 → CPU CIRCUIT SECTION 590 |
| OPERATION TERMINATION SIGNAL 602 | CPU CIRCUIT SECTION 390 → CPU CIRCUIT SECTION 590 |
| SHEET DISCHARGE SIGNAL 603 | CPU CIRCUIT SECTION 390 → CPU CIRCUIT SECTION 590 |
| BUNDLE DISCHARGE REQUEST SIGNAL 604 | CPU CIRCUIT SECTION 390 → CPU CIRCUIT SECTION 590 |
| OPERATION STATE SIGNAL 611 | CPU CIRCUIT SECTION 390 ← CPU CIRCUIT SECTION 590 |
| BUNDLE DISCHARGE SIGNAL 612 | CPU CIRCUIT SECTION 390 ← CPU CIRCUIT SECTION 590 |
| ALARM SIGNAL 613 | CPU CIRCUIT SECTION 390 ← CPU CIRCUIT SECTION 590 |

*FIG. 10B*

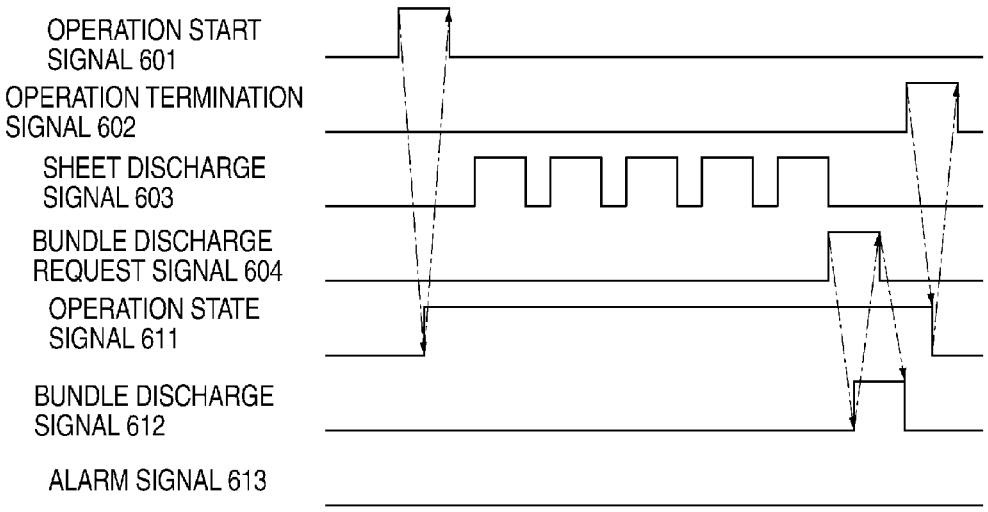

SHEET CONVEYING APPARATUS WITH ESCAPE SECTION THAT DOES NOT CONVEY SHEET TO POST-PROCESSING APPARATUS, AND POST-PROCESSING SYSTEM WITH ESCAPE SECTION THAT DOES NOT CONVEY SHEET TO POST-PROCESSING UNIT

BACKGROUND OF THE INVENTION

Field of the Invention

The present invention relates to a sheet conveying apparatus that is communicably connected to a post-processing apparatus and conveys a sheet to the post-processing apparatus, an image forming apparatus, an image formation system, and a post-processing system.

Description of the Related Art

Conventionally, there has been known a post-processing apparatus, such as a bookbinding apparatus, that performs post-processing, such as saddle-stitch bookbinding, case binding, and ring binding. Further, for the market of production printing, there has been proposed a bookbinding system in which a post-processing apparatus is connected to an image forming apparatus, such as a printer and a digital multifunction peripheral, to thereby seamlessly perform processing from printing to bookbinding.

In a bookbinding system including a ring binder, there has been proposed a technique for detecting a ring abnormality in a ring cartridge that stocks a plurality of rings for binding a sheet bundle, and inhibiting ring binding when the ring abnormality is detected (U.S. Pat. No. 8,132,994). Examples of the ring abnormality include an abnormality of a set state of the rings in the cartridge and an insufficient remaining amount of the same.

The post-processing apparatus, such as a bookbinding apparatus, has various functions and adjustment items, and accordingly, a user interface section of an image forming apparatus having the bookbinding apparatus connected thereto is required to be capable of setting these functions and adjustment items of the bookbinding apparatus. To display information e.g. of these functions and adjustment items of the bookbinding apparatus on the user interface section of the image forming apparatus, and execute a job, the bookbinding apparatus and the image forming apparatus are required to perform communication therebetween for various purposes.

The bookbinding apparatuses in the production printing markets tend to be manufactured in small lots of a large number of models. The image forming apparatus does not necessarily have a genuine bookbinding apparatus connected thereto. That is, the configuration of a bookbinding system which is constructed by a selected combination of an image forming apparatus and a bookbinding apparatus depends on the needs of each user. It takes a lot of time to put such a bookbinding system on the market after adapting each bookbinding apparatus to the user interface section of the image forming apparatus and making each bookbinding apparatus communicable with the image forming apparatus.

To solve this problem, there has been proposed a bookbinding system using a simple communication interface between a bookbinding apparatus and an image forming apparatus, which is simplified to such an extent that only transmission and reception of a signal indicative of delivery and reception of a sheet can be performed. In this system, a user interface is provided in each bookbinding apparatus, and configuration and adjustment of post-processing can be performed via the user interface.

Incidentally, there has been proposed a sheet conveying apparatus provided with the above-mentioned simple communication interface, for easily connecting various bookbinding apparatuses to an image forming apparatus. By connecting an image forming apparatus and a bookbinding apparatus via the sheet conveying apparatus, a bookbinding system is constructed which performs bookbinding processing without exchanging detailed information between the image forming apparatus and the bookbinding apparatus. In such a bookbinding system, the sheet conveying apparatus conveys out a sheet subjected to image formation, which is conveyed in from the image forming apparatus connected to the upstream side, to a post-processing apparatus such as the bookbinding apparatus.

The post-processing apparatus sometimes becomes incapable of continuing the bookbinding operation e.g. in a case where the amount of consumables of the bookbinding apparatus (e.g. remaining amount of ring members) becomes smaller than a predetermined amount. However, in the above-described bookbinding system in which detailed information is not exchanged between the post-processing apparatus and the image forming apparatus, even when the post-processing apparatus has become incapable of continuing the post-processing operation, such as bookbinding, it is difficult to properly stop the post-processing job. For example, even when "exhaustion of consumables" is detected, the job cannot be stopped quickly enough depending on a sheet conveying distance from a sheet feeder of the image forming apparatus to the post-processing apparatus, productivity of image formation, or the number of sheets per one copy of a finished product, which may cause e.g. a jam.

That is, after the post-processing apparatus has become incapable of continuing the post-processing operation e.g. due to exhaustion of consumables necessary for the post-processing operation or a fully-stacked state of products, the number of sheets which can be received by the post-processing apparatus without causing a jam or the like is different depending on each type of the post-processing apparatus. On the other hand, the post-processing apparatus connected to the sheet conveying apparatus is not necessarily genuine. Therefore, the sheets may be excessively supplied to the post-processing apparatus after the image forming apparatus or the sheet conveying apparatus recognizes that the post-processing apparatus has become incapable continuing the post-processing operation.

SUMMARY OF THE INVENTION

The present invention restricts conveyance of sheets to a post-processing apparatus which has become incapable of continuing a post-processing operation.

In a first aspect of the present invention, there is provided a sheet conveying apparatus that communicably connects a post-processing apparatus that performs post-processing on a sheet bundle formed by a plurality of sheets, comprising a conveying unit configured to convey a sheet, an escape section configured to receive the sheet conveyed by the conveying unit without conveying the sheet to the post-processing apparatus, a switching unit configured to change a conveying destination of the sheet by the conveying unit to one of the post-processing apparatus and the escape section, a count unit configured to count a value corresponding to the number of sheet bundles to be formed by sheets conveyed to the post-processing apparatus, and a control unit configured to determine whether or not it is impossible to continue a post-processing operation by the post-processing apparatus based on communication with the post-processing apparatus, and in a case where it is determined that it is impossible to continue the post-processing operation, control the switching unit based on the value counted by the count unit.

In a second aspect of the present invention, there is provided an image formation system comprising an image formation unit configured to perform image formation on a sheet, a post-processing unit configured to perform post-processing on the sheet subjected to the image formation by the image formation unit, an escape section configured to receives the sheet subjected to image formation by the image formation unit without conveying the sheet to the post-processing unit, a switching unit configured to change a conveying destination of the sheet to one of the post-processing apparatus and the escape section, a determination unit configured to determine whether or not it is impossible to continue a post-processing operation by the post-processing unit, a count unit configured to count a value corresponding to the number of sheet bundles to be formed by sheets conveyed to the post-processing unit, and a control unit configured to, in a case where it is determined by the determination unit that it is impossible to continue the post-processing operation by the post-processing unit, control the switching unit based on the value counted by the count unit.

In a third aspect of the present invention, there is provided a post-processing system comprising a conveying unit configured to convey a sheet, a post-processing unit configured to perform post-processing on the sheet conveyed by the conveying unit, an escape section configured to receive the sheet conveyed by the conveying unit without conveying the sheet to the post-processing unit, a switching unit configured to change a conveying destination of the sheet conveyed by the conveying unit to one of the post-processing apparatus and the escape section, a determination unit configured to determine whether or not it is impossible to continue a post-processing operation by the post-processing apparatus, a count unit configured to count a value corresponding to the number of sheet bundles to be formed by sheets conveyed to the post-processing apparatus, and a control unit configured to, in a case where it is determined by the determination unit that it is impossible to continue the post-processing operation, control the switching unit based on the value counted by the count unit.

In a fourth aspect of the present invention, there is provided an image forming apparatus that has a post-processing apparatus that performs post-processing on a sheet bundle formed by a plurality of sheets, communicably connected thereto, comprising an image formation unit configured to perform image formation on a sheet, a conveying unit that includes a conveying path for conveying a sheet subjected to the image formation by the image formation unit, and a receiving unit for receiving the sheet without conveying the sheet to the post-processing apparatus, a determination unit configured to determine whether or not it is impossible to continue a post-processing operation by the post-processing apparatus, a setting unit configured to manually set a threshold value for specifying an upper limit value of sheets which can be conveyed to the post-processing apparatus after it is determined by the determination unit that it is impossible to continue the post-processing operation by the post-processing apparatus, and a control unit configured to, in a case where it is determined by the determination unit that it is impossible to continue the post-processing operation by the post-processing apparatus, control the conveying unit based on the threshold value set by the setting unit.

According to the present invention, it is possible to restrict conveyance of sheets to the post-processing apparatus which has become incapable of continuing the post-processing operation Further features of the present invention will become apparent from the following description of exemplary embodiments (with reference to the attached drawings).

BRIEF DESCRIPTION OF THE DRAWINGS

FIG. 10A is a list of signals exchanged via a communication interface.

FIG. 10B is a timing diagram showing an example of a flow of signals exchanged during ring binding.

DESCRIPTION OF THE EMBODIMENTS

The present invention will now be described in detail below with reference to the accompanying drawings showing embodiments thereof.

Figure 1:
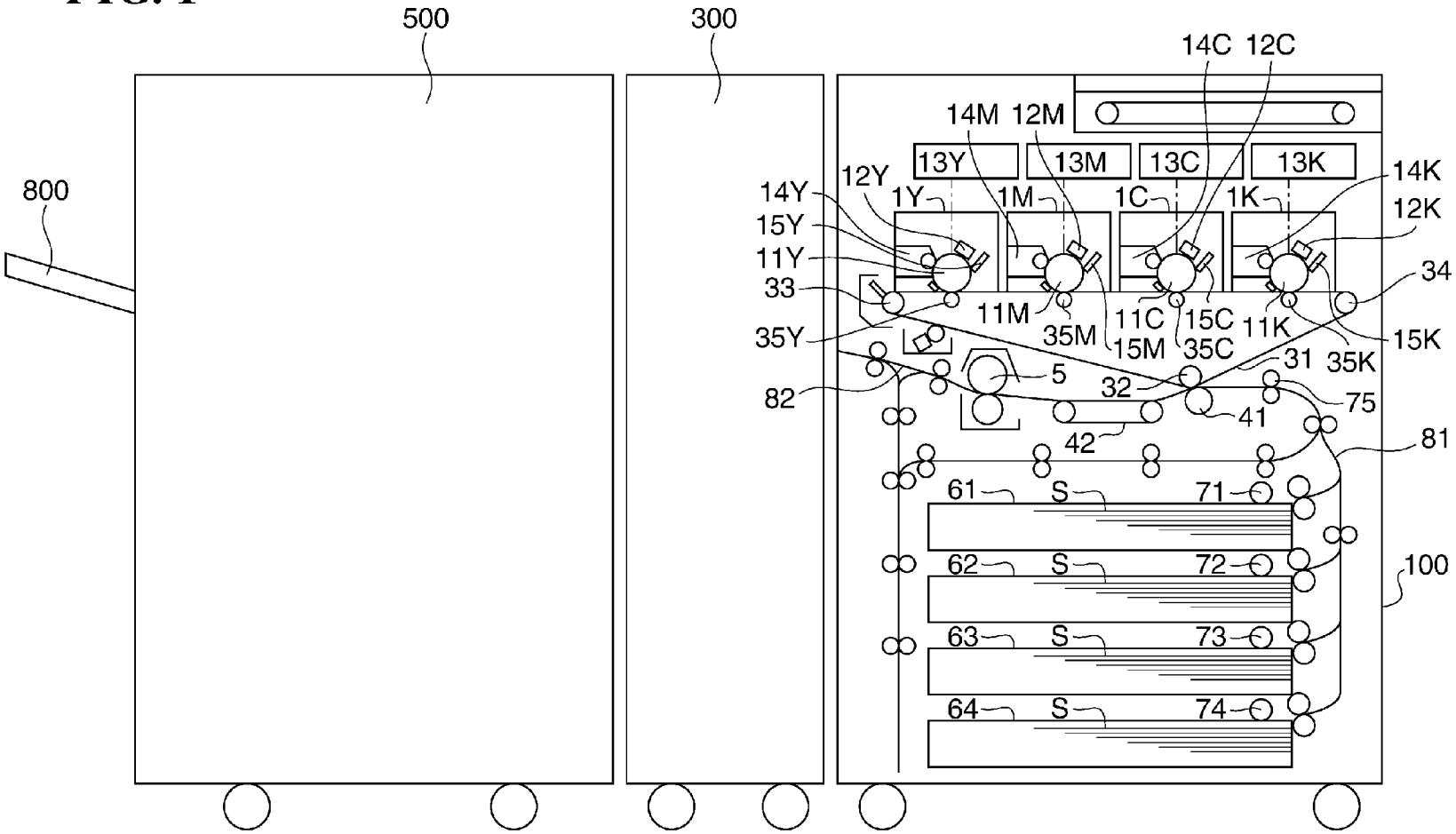
FIG. 1 is a schematic diagram of a bookbinding system to which a sheet conveying apparatus according to an embodiment of the present invention is applied.

FIG. 1 is a schematic diagram of a bookbinding system to which a sheet conveying apparatus according to an embodiment of the present invention is applied, in which an image forming apparatus is illustrated in cross-section.

This bookbinding system is comprised of the image forming apparatus, denoted by reference numeral 100, a conveying unit (sheet conveying apparatus) 300, and a bookbinding apparatus 500. The image forming apparatus 100 is communicably connected to the conveying unit 300, and the bookbinding apparatus 500 is communicably connected to the conveying unit 300. Physically, the image forming apparatus 100 is disposed at a most upstream location in a sheet conveying direction, the bookbinding apparatus 500 is disposed at a most downstream location in the sheet conveying direction, and a sheet output from the image forming apparatus 100 is guided into the bookbinding apparatus 500 via the conveying unit 300. Note that in the present embodiment, the bookbinding apparatus 500 is assumed to be a non-genuine product, i.e. a product of a third party in relationship to the manufacturer of the image forming apparatus 100 and the conveying unit 300.

First, the image forming apparatus 100 includes four image formation units 1 (1Y, 1M, 1C, and 1K) for forming four-color images of yellow (Y), magenta (M), cyan (C), and black (K). Each image formation unit 1 has the same components, and hence when the components are not distinguished from each other, on an image formation unit-by-image formation unit basis, the same reference numerals are used, whereas when the components are distinguished, Y, M, C, and K are added to the reference numeral 1.

The image forming apparatus 100 is a tandem intermediate transfer-type color image forming apparatus in which the image formation units 1Y, 1M, 1C, and 1K are serially arranged in a manner opposed to a horizontal portion of an intermediate transfer belt 31. The image forming apparatus 100 forms a full-color image on a sheet S by an electrophotographic process according to image signals transmitted from an external apparatus.

The image formation units 1 form toner images of the respective colors on photosensitive drums (11Y, 11M, 11C, and 11K), and transfers the toner images onto the intermediate transfer belt 31. The intermediate transfer belt 31 is rotated in a state stretched by a drive roller 33, a tension roller 34, and a transfer opposed roller 32 for transferring an image onto a sheet. Primary transfer rollers 35 (35Y, 35M, 35C, and 35K) for transferring an image are disposed at respective positions opposed to the photosensitive drums 11Y, 11M 11C, and 11K on a side of an inner peripheral surface of the intermediate transfer belt 31.

Around the photosensitive drums 11 are respectively disposed charging wires 12 (12Y, 12M, 12C, and 12K) for uniformly charging the respective surfaces of the photosensitive drums 11 and exposure devices 13 (13Y, 13M, 13C, and 13K) for irradiating the photosensitive drums 11 with respective image lights to thereby form electrostatic latent images thereon. Also respectively disposed around the photosensitive drum 11 are developing devices 14 (14Y, 14M, 14C, and 14K) for transferring associated toners onto the latent images formed on the photosensitive drums 11 to thereby form toner images thereon. Also respectively disposed therearound are cleaning members 15 (15Y, 15M, 15C, and 15K) for eliminating the associated toners remaining on the photosensitive drums 11 after transfer of the toner images onto the intermediate transfer belt 31.

The sheets S stored in sheet feed cassettes 61, 62, 63, and 64 are each conveyed to a sheet feed conveying path 81 by rotating an associated one of sheet feed rollers 71, 72, 73, and 74. A resist roller 75 feeds the sheet S to a secondary transfer section formed by a nip between a secondary transfer roller 41 and the transfer opposed roller 32 in synchronism with the toner images on the intermediate transfer belt 31.

A heat fixing device 5 is formed by upper and lower rollers, and the pressure of the upper and lower rollers can be variably set. The upper roller out of the two rollers contains a halogen lamp (heat generation member), and the halogen lamp has its output controlled, whereby the amount of heat of the heat fixing device 5 is adjusted.

The sheet S on which the toner images have been transferred is conveyed to the heat fixing device 5 by a conveyor belt 42, wherein the toner images are fixed onto the surface of the sheet S by heat and pressure applied by the heat fixing device 5, whereby a full-color image is formed. Then, the sheet S having the color image fixed thereon is delivered to the conveying unit 300 through a sheet discharge conveying path 82.

Figure 2:
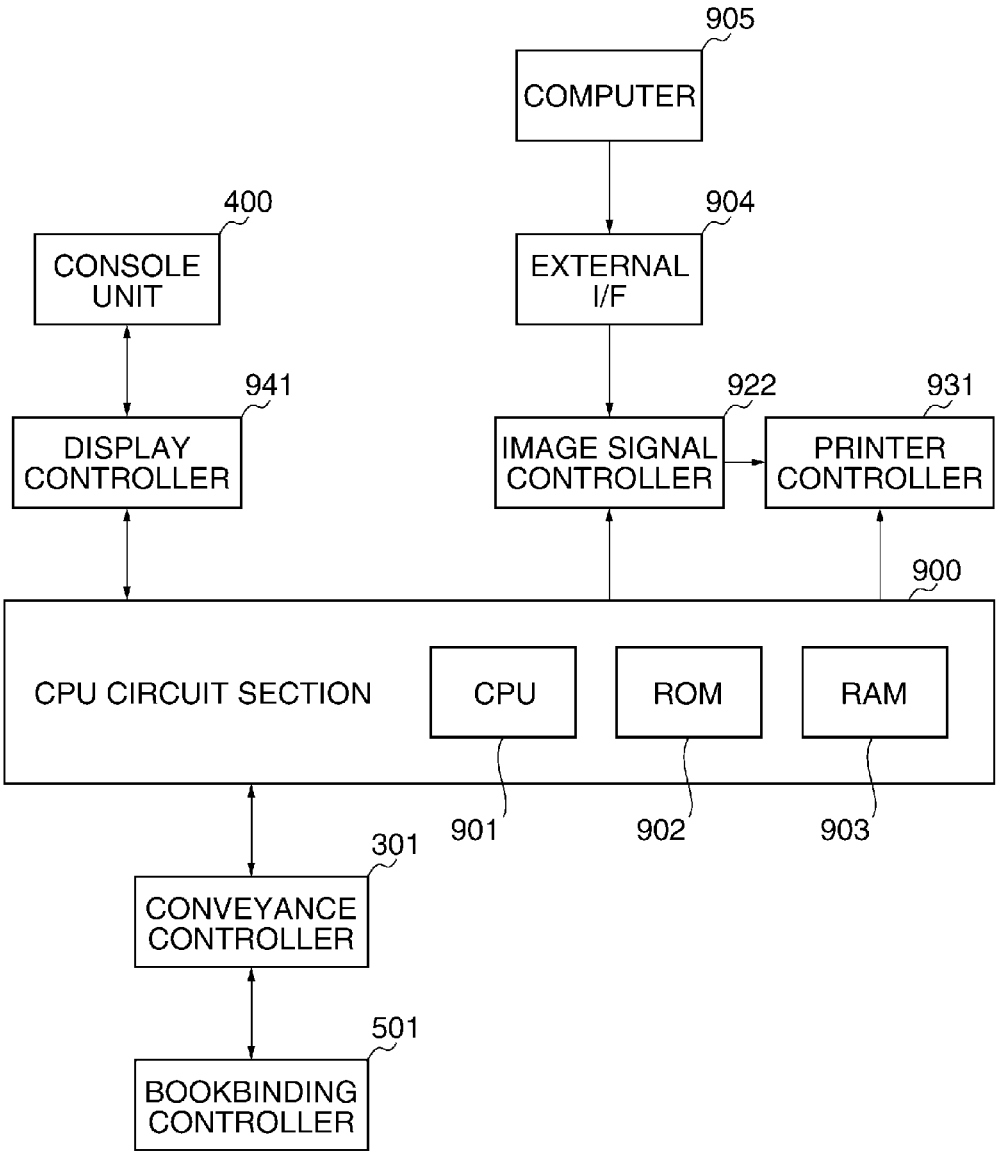
FIG. 2 is a block diagram of a controller of an image forming apparatus and components connected to the controller.

Next, a description will be given of a controller that controls the overall operation of the image forming apparatus 100 with reference to FIG. 2. FIG. 2 is a block diagram of the controller of the image forming apparatus 100 and components connected to the controller.

This controller includes a CPU circuit section 900, an image signal controller 922, a printer controller 931, and a display controller 941. The CPU circuit section 900 incorporates a CPU 901, a ROM 902, and a RAM 903, and performs centralized control of the blocks 922, 931, and 941 according to a control program stored in the ROM 902. The RAM 903 temporarily stores control data, and is also used as a work area for arithmetic processing involved in the control.

The image signal controller 922 performs various processing on digital image signals input from a computer 905 via an external interface 904, converts the digital image signals into video signals, and outputs the video signals to the printer controller 931. The processing operation performed by the image signal controller 922 is controlled by the CPU circuit section 900. The printer controller 931 drives the exposure devices 13 based on the input video signals. The CPU 901 controls the printer controller 931 to perform image formation and various adjustments.

A conveyance controller 301 of the conveying unit 300 is electrically (communicably) connected to the CPU circuit section 900, and a bookbinding controller 501 of the bookbinding apparatus 500 is electrically (communicably) connected to the conveyance controller 301.

Figure 11:
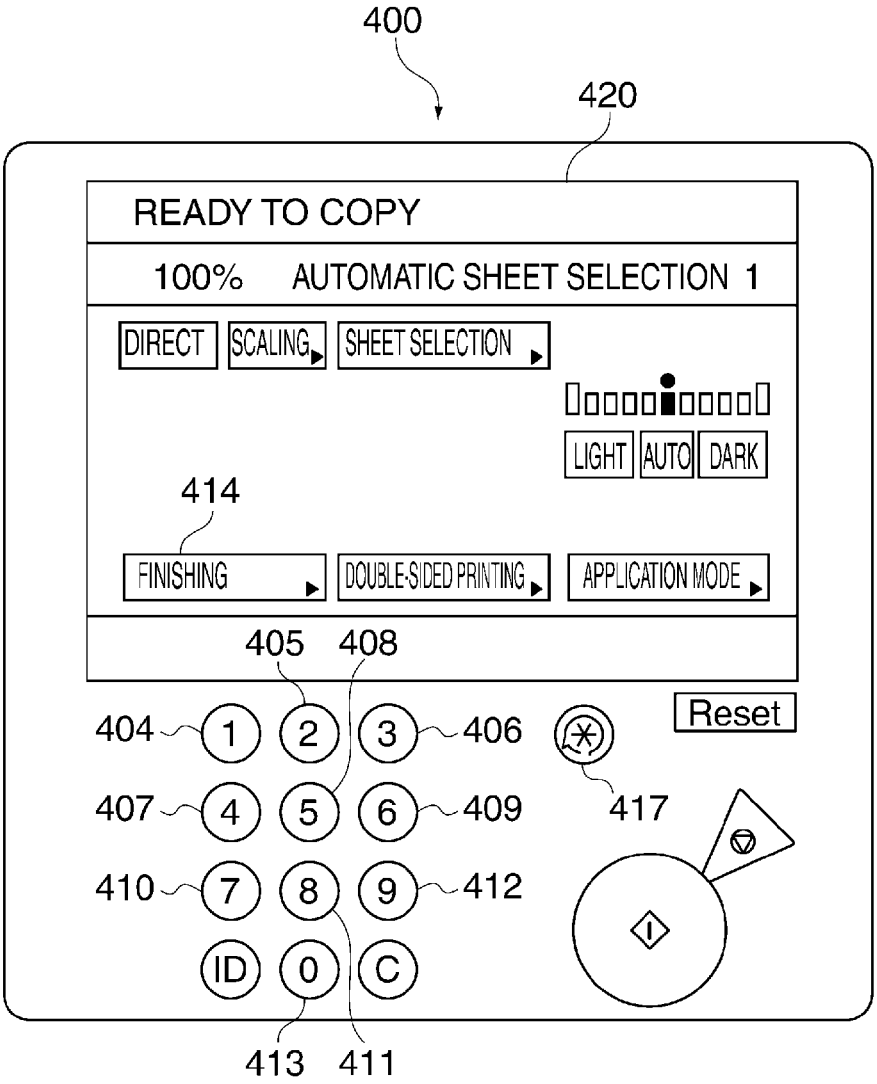
FIG. 11 is a diagram of a console unit.

The display controller 941 exchanges information with a console unit 400 and the CPU circuit section 900. The console unit 400, as shown in FIG. 11, includes a plurality of keys for configuring various functions associated with image formation, and a display section 420 for displaying information indicative of a state of configuration. More specifically, the display section 420 including a touch panel is arranged in an upper portion of the console unit 400, and soft keys can be created on a screen of the display section 420. Various keys, such as numeric keys 404 to 413, are arranged in a lower portion of the display section 420. A key signal corresponding to the operation of each key is output to the CPU circuit section 900, and information corresponding to the operation of each key is displayed on the display section 420 controlled by the display controller 941 based on a signal output from the CPU circuit section 900.

Figure 3:
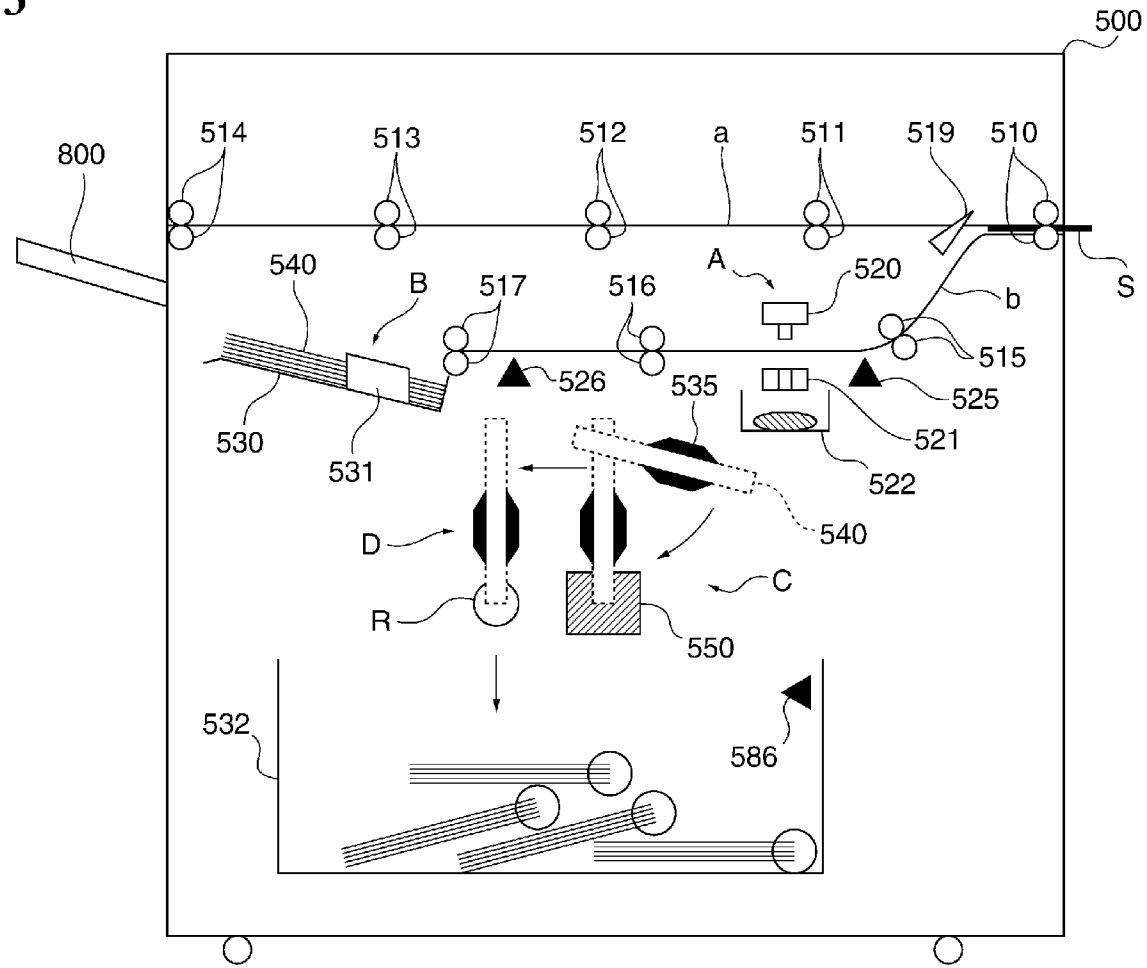
FIG. 3 is a schematic cross-sectional view of a bookbinding apparatus.

FIG. 3 is a schematic cross-sectional view of the bookbinding apparatus 500.

The bookbinding apparatus 500 receives a sheet S conveyed out of the conveying unit 300 into the bookbinding apparatus 500 by a conveying roller pair 510. If the received sheet S is a sheet to be conveyed to a stacking tray 800, the bookbinding apparatus 500 drives a solenoid, not shown, to switch a switching flapper 519 so that the sheet S is guided to a conveying path "a". The sheet S guided to the conveying path "a" is conveyed downstream by conveying roller pairs 511, 512, 513, and 514, and is then discharged into the stacking tray 800. If the received sheet S is a sheet to be subjected to bookbinding processing, the bookbinding apparatus 500 switches the switching flapper 519 so that the sheet S is guided to a conveying path "b".

The sheet S guided to the conveying path "b" is subjected to punching at a sheet punching section A. The sheet S nipped by a conveying roller pair 515 is conveyed downstream, and is further nipped and conveyed by a conveying roller pair 516. Then, when a punch trailing edge detection sensor 525 detects a trailing edge of the sheet S, the sheet S is conveyed by a predetermined distance, and then driving of the conveying roller pair 516 is stopped. A punching unit 520 is driven by a punch motor, not shown, to be lowered to the sheet S stopped at a position conveyed from the punch trailing edge detection sensor 525 by the predetermined distance, and be lifted up after reaching a receiving section 521. The sheet S is sandwiched between the punching unit 520 and the receiving section 521, whereby the sheet S is punched, and punching dust generated by punching is received in a punch dust box 522.

When the punching unit 520 is lifted up to terminate punching of the sheet S, the conveying roller pair 516 and a conveying roller pair 517 are driven to resume the downstream conveyance of the sheet S having stopped in the conveying path "b". Then, when the trailing edge of the sheet S is detected by a sheet discharge sensor 526 disposed at a location upstream of the discharge roller pair 517, the conveying speed is changed to a predetermined speed, and the sheet S is discharged into a stacking tray 530 of a sheet stacking section B.

Next, the operation of the sheet stacking section B will be described. The sheet S discharged by the discharge roller pair 517 into the stacking tray 530 one by one returns toward an upstream side in a discharging direction by its own weight, and is brought into abutment with an abutment member. The plurality of sheets S are each discharged into the stacking tray 530 in the same manner to form a sheet bundle 540 having edge portions of the sheets aligned in the discharging direction.

Further, width alignment members 531 are provided on the stacking tray 530 on the near side and the far side, as viewed in FIG. 3, respectively. When the leading edge of the sheet S reaches the discharge roller pair 517, the width alignment members 531 on the near and far sides are set on standby at respective positions 10 mm away from the lateral sides of the sheets outward in a sheet width direction orthogonal to the sheet discharging direction. After each sheet S has been stacked on the stacking tray 530, the two width alignment members 531 are moved toward each other, whereby the lateral edges of the sheets are aligned (alignment operation).

Whenever one sheet S is discharged into the stacking tray 530, this alignment operation is repeated, and the sheet bundle 540 having the sheets S accurately aligned in lateral and longitudinal directions is formed by the above-described operation for aligning the edges of the sheets in the discharging direction and the alignment operation.

Next, the operation of a bookbinding section C will be described with reference to FIGS. 3 to 6C.

FIGS. 4A to 4D are transition diagrams useful in explaining a ring binding operation. The sheet bundle 540 stacked and aligned on the stacking tray 530 is held by a gripper 535 on the stacking tray 530, and is moved as a bundle from the sheet stacking section B to a position above the bookbinding section C (see FIG. 4A). The sheet bundle 540 moved by the gripper 535 to the position above the bookbinding section C is turned while being held by the gripper 535 such that an end portion to be bound by a ring R is set downward (see FIG. 4B).

In the bookbinding section C, the gripper 535 and a ring conveying section 550 perform ring binding on the sheet bundle 540 using the ring R having a spiral shape. The operation for attaching the ring to the sheet bundle 540 in the bookbinding section C will be described with reference to FIGS. 5 and 6A to 6C.

Figure 5:
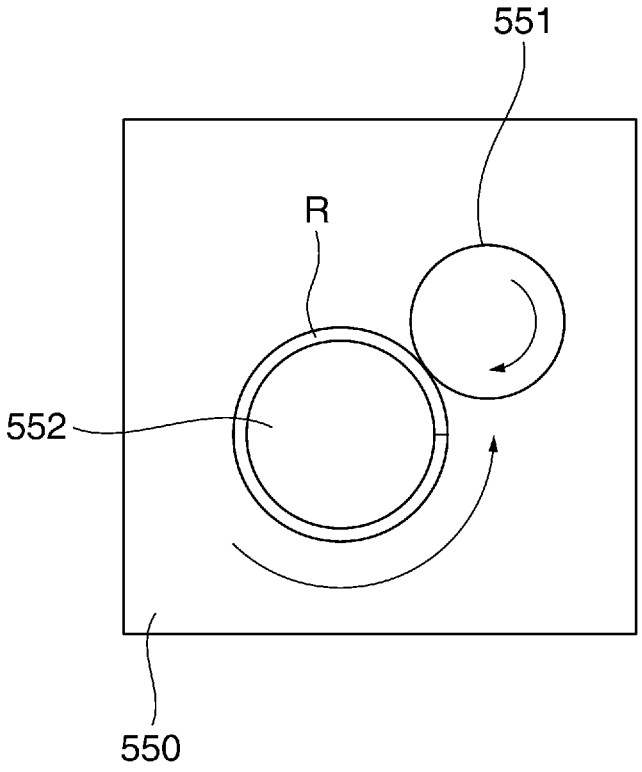
FIG. 5 is a diagram of a ring conveying section, as viewed from the near side in FIG. 3.
Figure 6A:
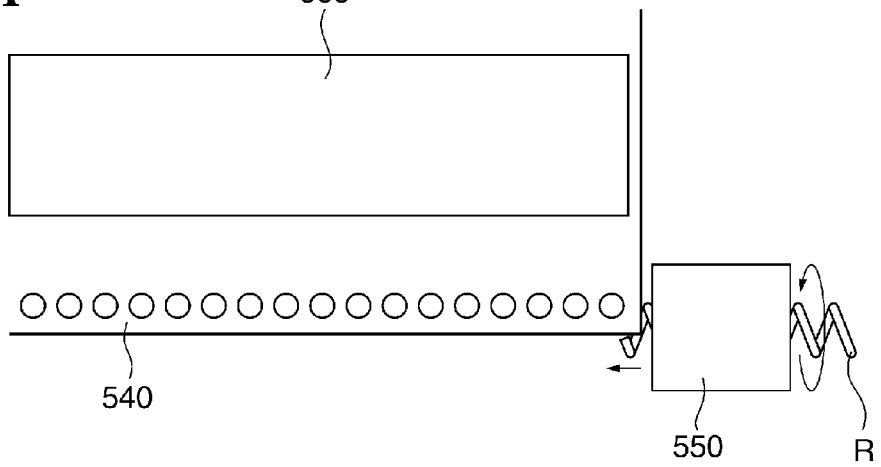
FIGS. 6A to 6C are diagrams of a bookbinding section, as viewed from a direction orthogonal to a ring conveying direction.
Figure 6B:
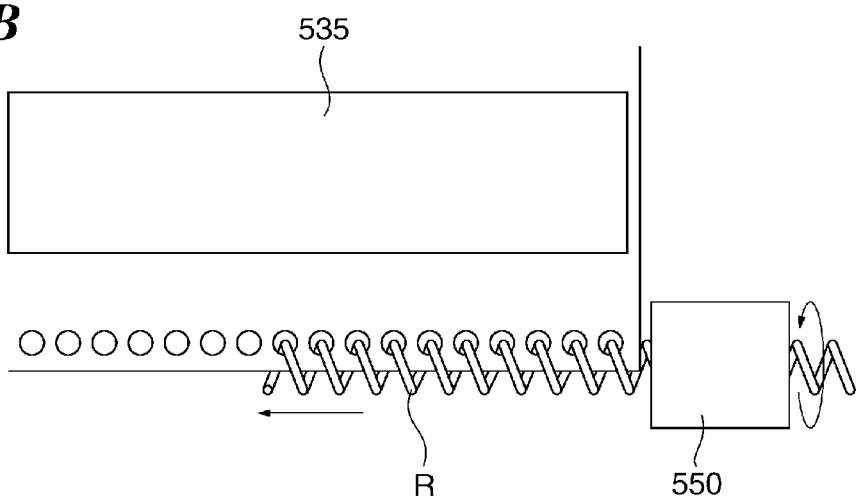
Figure 6C:
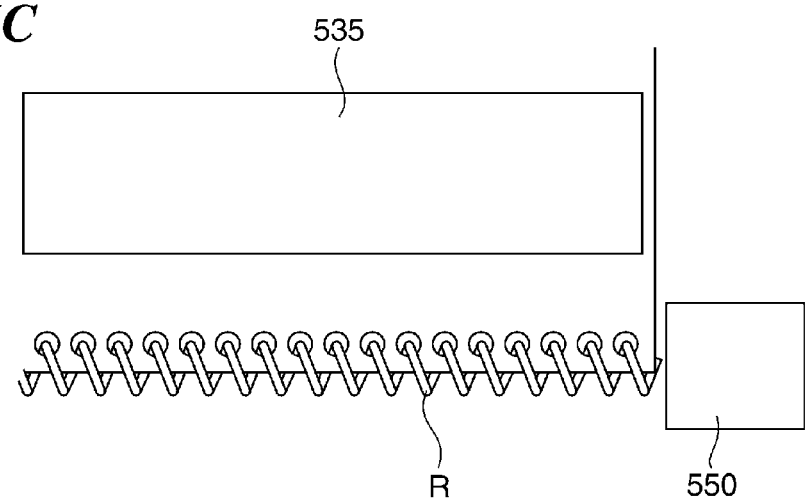

FIG. 5 is a diagram of the ring conveying section 550, as viewed from the near side in FIG. 3. FIGS. 6A to 6C are diagrams of the bookbinding section C, as viewed from a direction orthogonal to a direction of conveying the ring R (depth direction as viewed in FIG. 3 and direction of a rotational axis about which the ring R is turned while being conveyed).

As shown in FIG. 5, the ring conveying section 550 is comprised of a ring conveying roller 551, a motor, not shown, for driving the ring conveying roller 551, and a ring insertion shaft 552. The ring insertion shaft 552 has an outer diameter substantially equal to an inner diameter of the ring R, and has a surface formed with a spiral groove at the same pitch as the ring R. The ring insertion shaft 552 is fixed and is not rotated even when the ring conveying roller 551 is rotated.

To convey the ring R, the ring conveying roller 551 is rotated by the motor in a direction indicated by an arrow (clockwise direction) in FIG. 5 in a state where the ring conveying roller 551 is brought into contact with the ring R set on the ring insertion shaft 552. By rotating the ring conveying roller 551, the ring R set in the spiral groove of the ring insertion shaft 552 is forced to rotate, whereby the ring R is conveyed in the direction of the rotational axis while rotating along the groove of the ring insertion shaft 552. Then, the ring R is sequentially forwarded out from the ring conveying section 550 toward the sheet bundle 540, starting with the front end thereof.

When the sheet bundle 540 is moved to a bookbinding position by the gripper 535, the conveying of the ring R is started by the ring conveying section 550 (see FIG. 6A). The front end of the ring R forwarded by the ring conveying section 550 is inserted, while rotating, through punched holes of the sheet bundle 540 held by the gripper 535, starting from a punched hole formed in an edge portion on the near side as viewed in FIG. 3 (right side, as viewed in FIGS. 6A to 6C), and is sequentially inserted through the punched holes toward the far side (see FIG. 6B). When the ring R has been inserted through all punched holes, this places the sheet bundle 540 in a state having the ring R set thereon, and the conveying of the ring R by the ring conveying section 550 is terminated (see FIG. 6C).

Figure 4A:
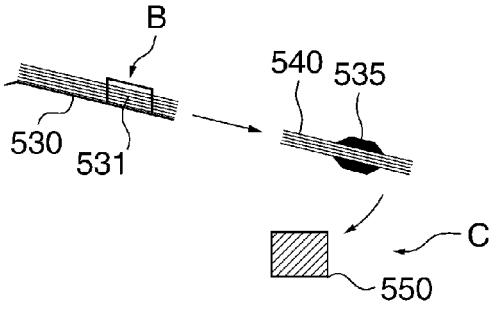
FIGS. 4A to 4D are transition diagrams useful in explaining a ring binding operation.
Figure 4B:
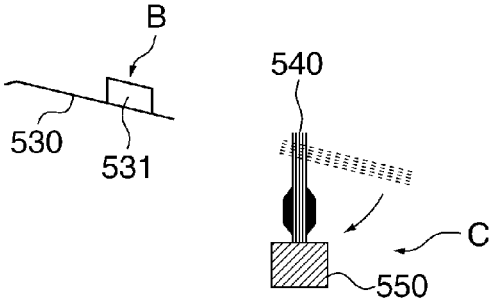
Figure 4C:
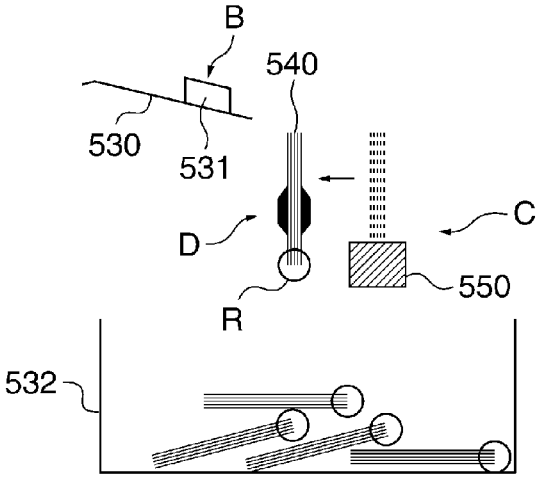
Figure 4D:
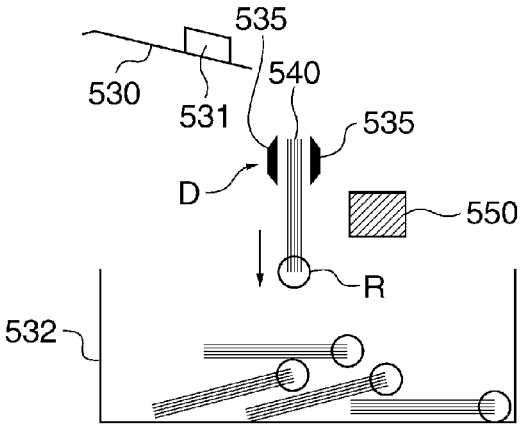

As shown in FIG. 4C, the sheet bundle 540 having the ring R set thereon is horizontally translated while being held by the gripper 535 until it is moved to a bookbound object-discharging position D above a bookbound bundle-stacking box 532 which is a receiving section. Then, after the moving of the sheet bundle 540 by the gripper 535 is stopped, the sheet bundle 540 is released from the state held by the gripper 535, and the sheet bundle 540 as a product is dropped into the bookbound bundle-stacking box 532 (see FIG. 4D). Thus, the ring binding operation is completed.

Figure 7:
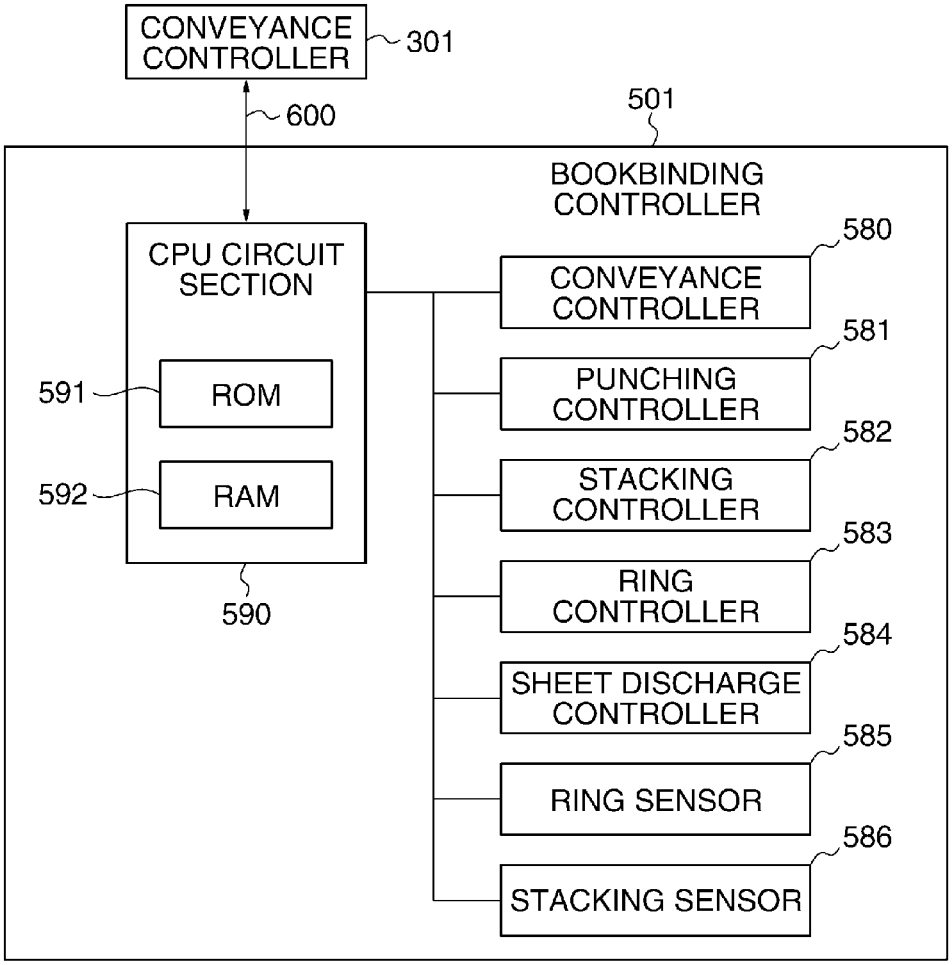
FIG. 7 is a block diagram of a bookbinding controller.

Next, a description will be given of the bookbinding controller 501 that controls the bookbinding apparatus 500 with reference to FIG. 7. FIG. 7 is a block diagram of the bookbinding controller 501.

The bookbinding controller 501 includes a CPU circuit section 590. The CPU circuit section 590 incorporates a ROM 591 and a RAM 592. The CPU circuit section 590 communicates with a CPU circuit section 390 (see FIG. 9) provided in the conveyance controller 301 (see FIG. 2) of the conveying unit 300 via a communication interface 600. The CPU circuit section 590 drives the bookbinding apparatus 500 by executing various programs stored in the ROM 591 based on instructions from the CPU circuit section 390.

The bookbinding controller 501 includes a ring sensor 585 and a stacking sensor 586. A drive controller for monitoring the various sensors and driving loads of the bookbinding apparatus 500 is comprised of blocks 580 to 584.

The ring sensor 585 detects whether or not the remaining amount of rings R set in a ring cartridge is exhausted (ring exhaustion). The stacking sensor 586 (see FIG. 3) disposed in the bookbound bundle-stacking box 532 detects whether or not the bookbound bundle-stacking box 532 is in a fully-stacked state in which the amount of sheet bundles 540 as products of bookbinding has reached the full amount (full stack). The detection results output from the ring sensor 585 and the stacking sensor 586 are supplied to the CPU circuit section 590. As the detection method used by the ring sensor 585 and the stacking sensor 586, optical-type detection, contact-type detection, and so on, are considered, but the configuration of these sensors is not limited. In the present embodiment, it is assumed that the output from the ring sensor 585 when the ring exhaustion is detected is High, and the output from the same when ring presence is detected is Low. It is also assumed that the output from the stacking sensor 586 when the full stack is detected is High, and the output from the same when the full stack is not detected is Low.

As to the blocks 580 to 584, first, a conveyance controller 580 drives the above-described conveyance of a sheet by the conveying roller pairs 510 to 517 through the conveying path "a" and the conveying path "b". A punching controller 581 drives the sheet punching section A. A stacking controller 582 drives the sheet stacking section B. A ring controller 583 drives the ring bookbinding section C. A sheet discharge controller 584 performs driving of the gripper 535 and associated components, not shown, such that the gripper 535 holding the sheet bundle 540 is moved to the bookbound object-discharging position D and the gripper 535 releases the sheet bundle 540 to discharge the sheet bundle 540 as a product to the bookbound bundle-stacking box 532.

Figure 8:
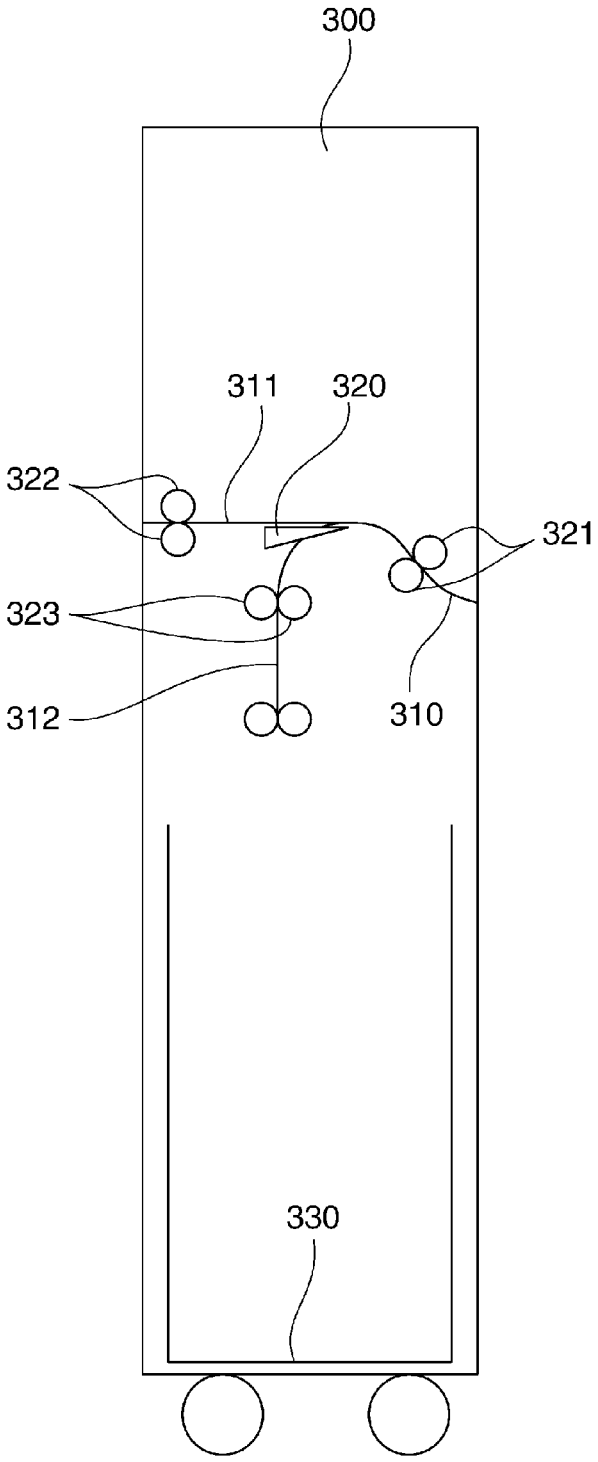
FIG. 8 is a schematic cross-sectional view of a conveying unit.

FIG. 8 is a schematic cross-sectional view of the conveying unit 300. The conveying unit 300 connects between the image forming apparatus 100 and the bookbinding apparatus 500. An escape tray 330 as an escape section for receiving sheets instead of conveying the same to the bookbinding apparatus 500 is provided at a lower part of the conveying unit 300.

A path 310 is bifurcated downstream into a conveying-out path 311 for guiding a sheet to the outside (to the bookbinding apparatus 500) and an escape path 312 for guiding a sheet to the escape tray 330, and a flapper 320 is disposed at the bifurcation point. The path 310 is provided with a conveying roller pair 321. The conveying-out path 311 and the escape path 312 are provided with conveying roller pairs 322 and 323, respectively.

The flapper 320 function as a switching unit configured to switch a conveying destination of the sheet S by the conveying unit (conveying roller pairs 321, 322, and 323) to one of the bookbinding apparatus 500 and the escape tray 330.

The sheets S conveyed in from the image forming apparatus 100 are sequentially received into the conveying unit 300 by the conveying roller pair 321, and are guided into the path 310. When the flapper 320 is at a first position on an upper side, each sheet S guided into the path 310 is conveyed out to the bookbinding apparatus 500 from the path 310 through the conveying path 311. When the flapper 320 is at a second position on a lower side, the sheet S guided into the path 310 is caused to escape from the path 310 to the escape tray 330 through the escape path 312.

Although details are described hereinafter, in a case where the bookbinding apparatus 500 is in a state incapable of receiving the sheet S, the flapper 320 is changed to the second position, whereby the sheet S is guided from the path 310 to the escape path 312 to be discharged into the escape tray 330.

Figure 9:
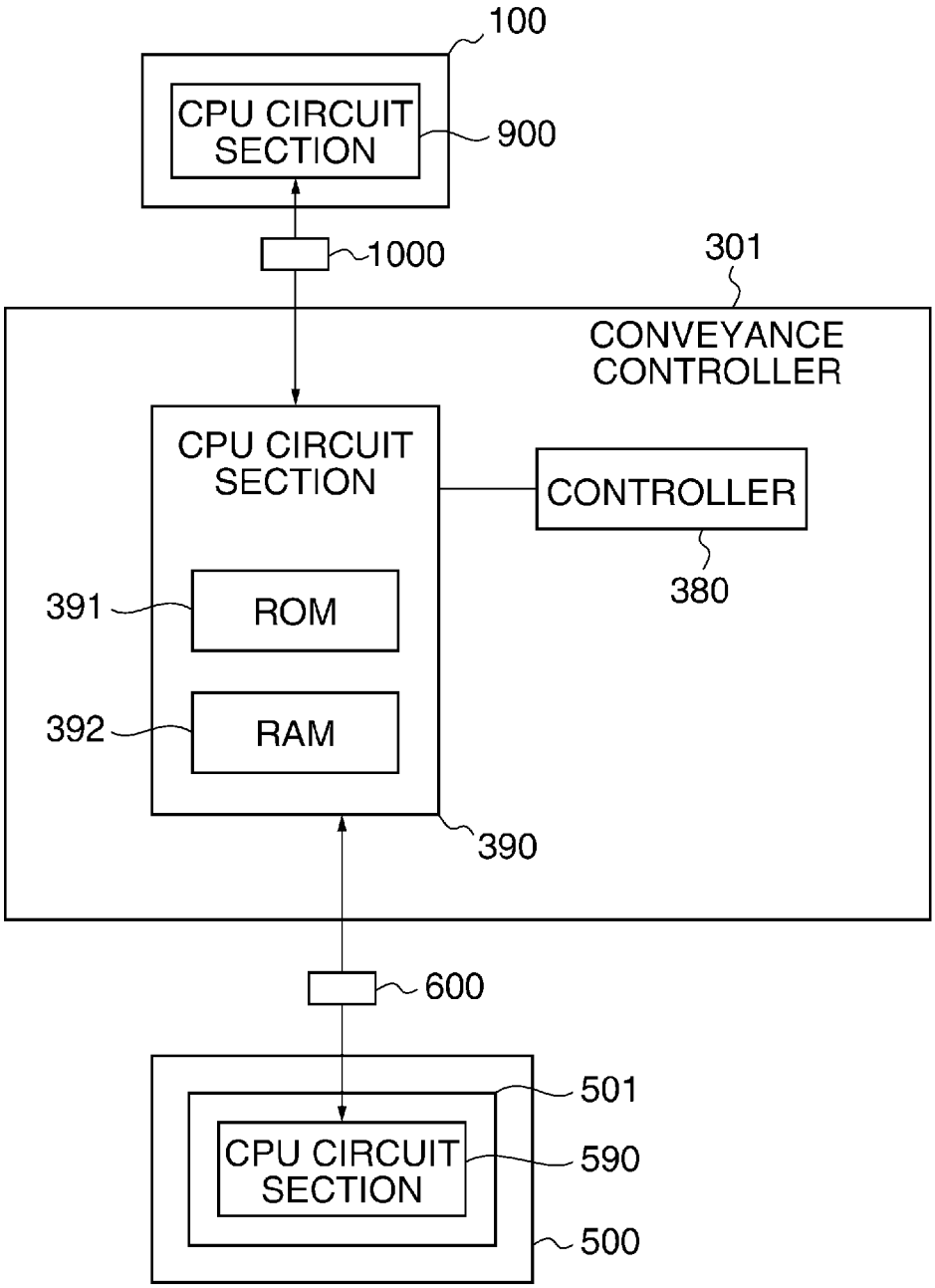
FIG. 9 is a block diagram of a conveyance controller and components which communicate with the conveyance controller.

Next, a description will be given of the conveyance controller 301 that controls the conveying unit 300 with reference to FIG. 9. FIG. 9 is a block diagram of the conveyance controller 301 and components which communicate with the conveyance controller 301.

The conveyance controller 301 includes the CPU circuit section 390 and a controller 380. The CPU circuit section 390 includes a ROM 391 and a RAM 392.

The controller 380 monitors various sensors, drives loads, and switches the flapper 320 (see FIG. 8) under the control of the CPU circuit section 390. Therefore, the CPU circuit section 390 functions as a control unit of the present invention, which is configured to control switching of the flapper 320. The CPU circuit section 390 is communicably connected to the CPU circuit section 900 of the image forming apparatus 100 via a communication interface 1000. The CPU circuit section 390 is further communicably connected to the CPU circuit section 590 of the bookbinding controller 501 of the bookbinding apparatus 500 via the communication interface 600 (see FIG. 7), which is different from the communication interface 1000. Note that when a genuine bookbinding apparatus is connected to the conveying unit 300, the CPU circuit section 390 can communicate with the bookbinding apparatus via a communication interface which is of the same type as the communication interface 1000.

Communication between the CPU circuit section 390 and the CPU circuit section 590 via the communication interface 600 will be described with reference to FIGS. 10A and 10B. FIG. 10A is a list of signals exchanged between the CPU circuit section 390 and the CPU circuit section 590 via the communication interface 600. FIG. 10B is a timing diagram showing an example of a flow of the signals exchanged via the communication interface 600 during ring binding.

The communication interface 600 is a general-purpose parallel communication interface that is comprised of a plurality of signal lines and is capable of exchanging a plurality of signals shown in FIG. 10A in parallel. The communication interface 1000 is a customized communication interface. The CPU circuit section 390 sends information to the CPU circuit section 590 via the communication interface 600 in response to a request from the CPU circuit section 900 sent via the communication interface 1000.

When a job is started, the CPU circuit section 390 sets the output level of an operation start signal 601 to High (in the present embodiment, the high level corresponds to an active state) to thereby notify the CPU circuit section 590 of the start of the operation. When preparation for a bookbinding operation is completed, the CPU circuit section 590 sets the output level of an operation state signal 611 to High to thereby send a response to the CPU circuit section 390.

Upon detection of the high level of the operation state signal 611, the CPU circuit section 390 changes the output level of the operating start signal 601 to Low (in the present embodiment, the low level corresponds to an inactive state).

A sheet discharge signal 603 is changed in output level from Low to High whenever delivery of one sheet S from the conveying unit 300 to the bookbinding apparatus 500 is started, and is changed in output level from High to Low whenever delivery of one sheet S is terminated.

A bundle discharge request signal 604 is a signal for notifying a request for performing ring binding of the sheet bundle 540 stacked on the stacking tray 530 of the bookbinding apparatus 500 (bookbinding request). Upon receipt of notification of the bookbinding request from the CPU circuit section 390 by the bundle discharge request signal 604, the CPU circuit section 590 controls the various loads to perform bookbinding, and after the product is discharged into the bookbound bundle-stacking box 532, notifies the CPU circuit section 390 of discharge of the bundle by a bundle discharge signal 612.

Upon detection of the high level of the bundle discharge signal 612, the CPU circuit section 390 changes the output level of the bundle discharge request signal 604 from High to Low.

When the job is interrupted or terminated, the CPU circuit section 390 changes the output level of an operation termination signal 602 from Low to High to thereby notify the CPU circuit section 590 of termination of the operation. When the operation for terminating bookbinding is completed, the CPU circuit section 590 changes the output level of the operation state signal 611 to Low to thereby sends a response to the CPU circuit section 390. Upon detection of the low level of the operation state signal 611, the CPU circuit section 390 changes the output level of the operation termination signal 602 to Low.

An alarm signal 613 is a signal output from the CPU circuit section 590 for notifying the CPU circuit section 390 of the ring exhaustion, which is detected by the ring sensor 585, and the full stack of the bookbound bundle-stacking box 532, which is detected by the stacking sensor 586. Note that the configuration may be such that the ring exhaustion and the full stack are separately notified from the CPU circuit section 590 to the CPU circuit section 390 by respective individual signals.

Although details are described hereinafter, the CPU circuit section 590 refers to the detection results output from the above-mentioned ring sensor 585 and the stacking sensor 586 at predetermined intervals to thereby monitor for the exhaustion of rings R in the ring cartridge and the full stack of the bookbound bundle-stacking box 532. As a consequence, if it is determined that the ring exhaustion or the full stack is detected, the CPU circuit section 590 changes the output level of the alarm signal 613 to High.

On the other hand, the CPU circuit section 390 refers to the level of the alarm signal 613 to thereby determine the exhaustion of rings R and the full stack of the bookbound bundle-stacking box 532. When the output level of the alarm signal 613 is changed to High, the CPU circuit section 390 determines that the ring exhaustion or the full stack is detected, i.e. the bookbinding apparatus 500 has become incapable of continuing the bookbinding operation.

When rings R are set in the ring cartridge, or bookbound bundles as products are taken away from the bookbound bundle-stacking box 532 by the user, the exhaustion of rings R or the full stack of the bookbound bundle-stacking box 532 is solved. This changes the detection result from the ring sensor 585 or the stacking sensor 586, and when neither the ring exhaustion nor the full stack is indicated, the CPU circuit section 590 changes the output level of the alarm signal 613 to Low.

When a number of sheets corresponding to the set number of sheet bundles are passed to the bookbinding apparatus 500 after detection of the high level of the alarm signal 613, the CPU circuit section 390 causes the flapper 320 to be switched to thereby discharge the following sheets to the escape tray 330. The set number mentioned above refers to a threshold value TH, which will be described in detail hereinafter.

Next, a description will be given of processing for setting the number of sheet bundles (threshold value TH) which are to be formed by sheets passed to the bookbinding apparatus 500 after the CPU circuit section 390 detects the high level of the alarm signal 613 with reference to FIGS. 11 and 12A to 12C. The threshold value TH is a value corresponding to the number of sheet bundles which can be conveyed to the bookbinding apparatus 500 by the conveying unit 300 after the ring exhaustion or the full stack is detected in the bookbinding apparatus 500.

Figure 12A:
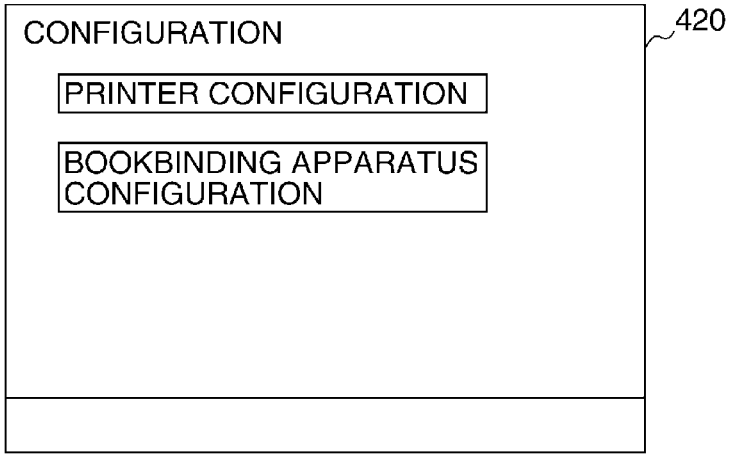
FIGS. 12A to 12C are diagrams showing examples of the display on a display section during bookbinding configuration.
Figure 12B:
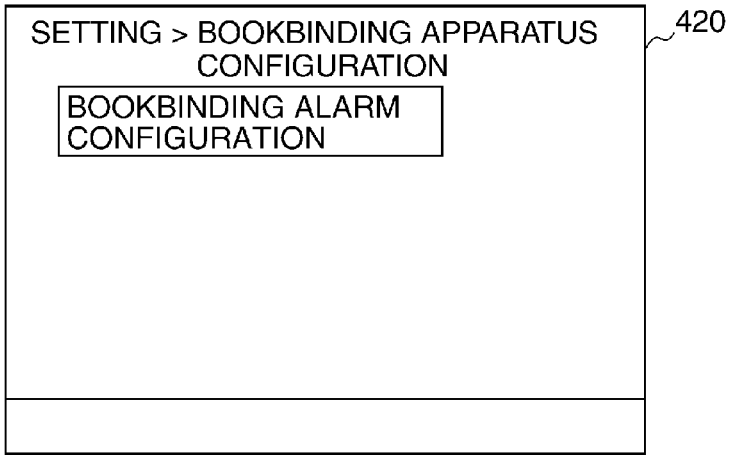
Figure 12C:
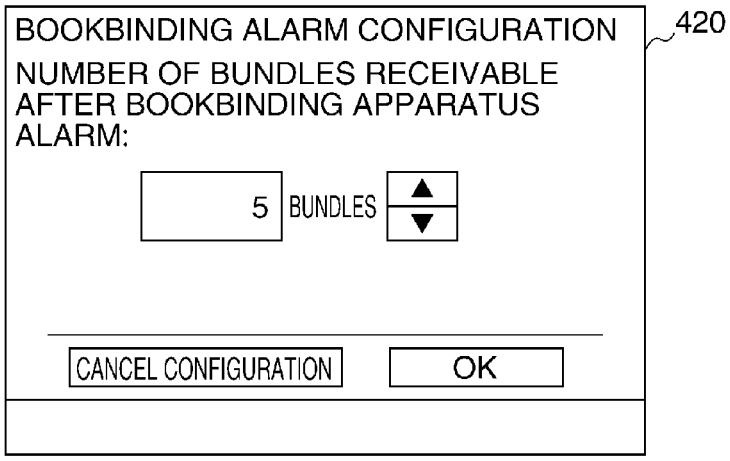

FIG. 11 is a diagram of the console unit 400. FIGS. 12A to 12C are diagrams showing examples of the display on the display section 420 during bookbinding configuration.

When a configuration key 417 provided on the console unit 400, shown in FIG. 11, is pressed, a configuration screen, shown in FIG. 12A, is displayed on the display section 420. When a soft key "bookbinding apparatus configuration" is pressed on the screen shown in FIG. 12A, a screen for configuring the bookbinding apparatus, shown in FIG. 12B, is displayed on the display section 420.

Then, when a soft key "bookbinding alarm configuration" is pressed on the screen shown in FIG. 12B, a bookbinding alarm configuration screen shown in FIG. 12C is displayed on the display section 420. On this screen, the user is prompted to set the upper limit number (threshold value TH) of sheet bundles to be passed to the bookbinding apparatus 500 after the bookbinding apparatus 500 outputs the alarm signal 613. The user can input a value of "the number of bundles receivable after bookbinding apparatus alarm" using upper/lower direction keys, appearing in FIG. 12C, or the numeric keys 404 to 413 provided on the console unit 400.

When a soft key "OK" is pressed on the screen shown in FIG. 12C after inputting the value, the CPU circuit section 900 notifies the CPU circuit section 390 of the set value via the communication interface 600. The CPU circuit section 390 stores received information indicative of the value in the RAM 392 as the threshold value TH. In the illustrated example in FIG. 12C, there is an entry of "five" bundles, and hence when the soft key "OK" is pressed, the value of "5" is set as the threshold value TH in the RAM 392.

Figure 13:
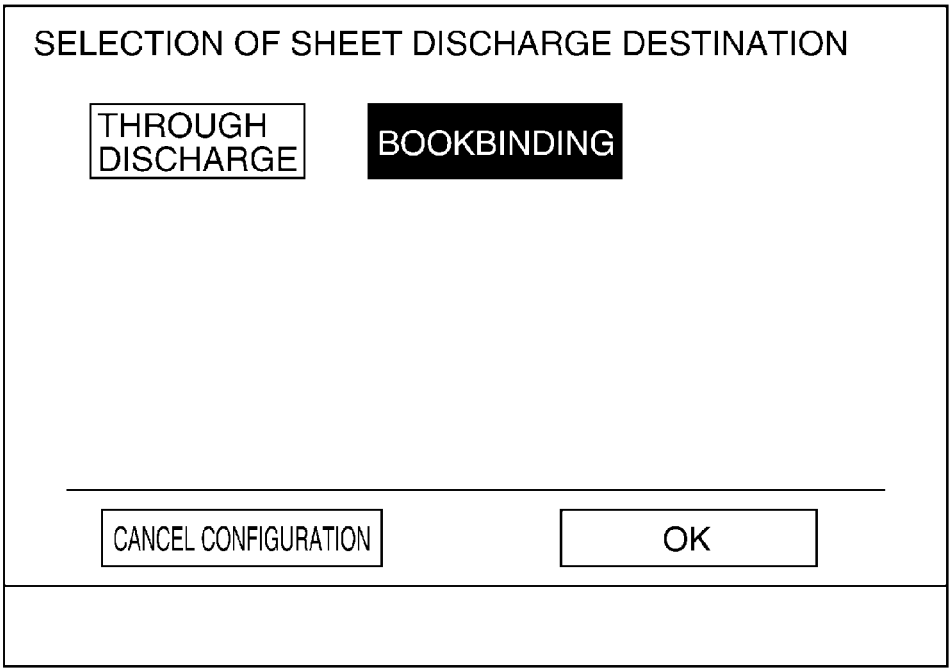
FIG. 13 is a diagram showing an example of the display on the display section during finishing configuration.

Input of a bookbinding job will be described with reference to FIGS. 11 and 13. FIG. 13 is a diagram showing an example of the display on the display section 420 during finishing configuration.

When a soft key "finishing" 414 displayed on the display section 420 of the console unit 400, appearing in FIG. 11, is pressed, a finishing configuration screen shown in FIG. 13 is displayed. When a soft key "bookbinding" is pressed on this finishing configuration screen, the bookbinding is set. When a job is subsequently input from the computer 905 via the external interface 904, image formation and bookbinding are started. Although detailed description is omitted, when a soft key "through discharge" is pressed on the finishing configuration screen shown in FIG. 13 and then a job is input, the sheet is discharged into the stacking tray 800 of the bookbinding apparatus 500 without being subjected to bookbinding processing.

Next, a description will be given of a flow of processes performed by the image forming apparatus 100 and the conveying unit 300 during execution of the bookbinding job with reference to FIGS. 14 and 15.

Figure 14:
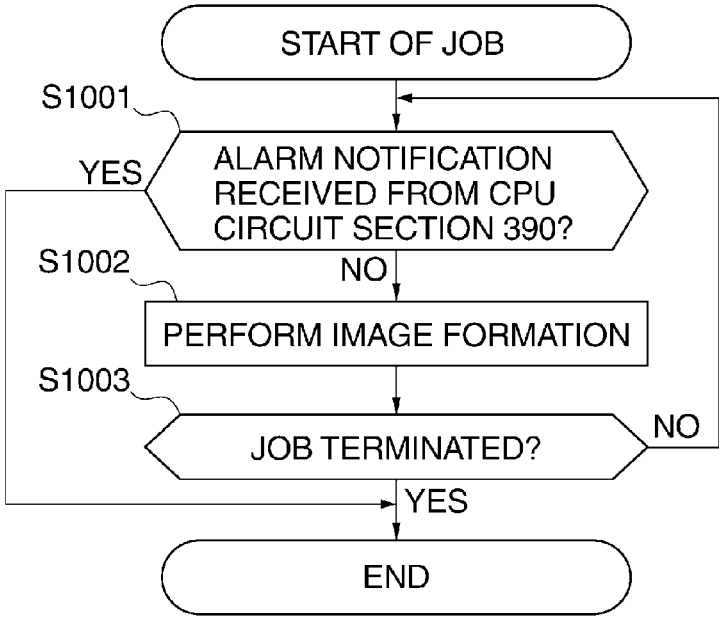
FIG. 14 is a flowchart of a job starting process performed by the image forming apparatus.

FIG. 14 is a flowchart of a job starting process performed by the image forming apparatus 100. In a step S1001, the CPU circuit section 900 of the image forming apparatus 100 determines whether or not an alarm notification is received from the CPU circuit section 390 of the conveying unit 300 via the communication interface 1000. This alarm notification is issued from the CPU circuit section 390 in a step S1210 in FIG. 16, described hereinafter.

If it is determined in the step S1001 that no alarm notification is received, the CPU circuit section 900 continues image formation based on the job (step S1002), and determines whether or not the job is terminated (step S1003). If the job is not terminated, the process returns to the step S1001, whereas if the job is terminated, the CPU circuit section 900 terminates the present process in FIG. 14.

On the other hand, if it is determined in the step S1001 that an alarm notification is received, the CPU circuit section 900 immediately terminates the present process in FIG. 14 without continuing image formation. That is, the CPU circuit section 900 interrupts the operation for feeding a sheet and forming an image. Therefore, the alarm notification corresponds to a notification for stopping the image forming operation. As mentioned above, the CPU circuit section 900 continues image formation unless the alarm notification is received, and interrupts image formation upon receipt of the alarm notification.

Figure 15:
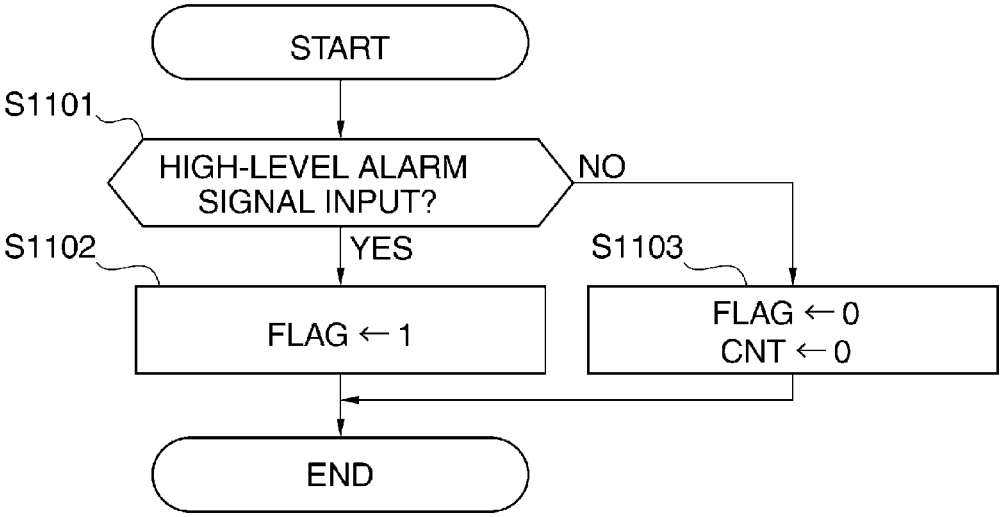
FIG. 15 is a flowchart of a process for determining impossibility of continuation of a bookbinding operation.

FIG. 15 is a flowchart of a process performed by the conveying unit 300, for determining impossibility of continuation of the bookbinding operation in the bookbinding apparatus 500.

In a step S1101, the CPU circuit section 390 of the conveying unit 300 determines whether or not the output level of the alarm signal 613 sent from the CPU circuit section 590 of the bookbinding apparatus 500 via the communication interface 600 is changed to High. If it is determined in the step S1101 that the output level of the alarm signal 613 is Low, in a step S1103, the CPU circuit section 390 resets both of a flag FLAG and a count value CNT stored in the RAM 392, to 0.

On the other hand, if the output level of the alarm signal 613 is High, the CPU circuit section 390 sets the flag FLAG to 1 in a step S1102. After execution of the step S1102 or S1103, the process in FIG. 15 is terminated. The process in FIG. 15 is repeatedly executed at regular intervals. Therefore, the CPU circuit section 390 repeats the steps S1101 to S1103 to thereby continue determination of the alarm signal 613 sent from the CPU circuit section 590 irrespective of whether or not a job is being executed.

As described above, the steps S1101 to S1103 of the process for determining impossibility of continuation of the bookbinding operation are processing steps for the CPU circuit section 390 to determine whether the bookbinding apparatus 500 can continue the bookbinding operation or has become incapable of continuing the bookbinding operation due to the ring exhaustion or the full stack of the bookbound bundle-stacking box 532, and store the determination result. Even when the CPU circuit section 390 determines that the bookbinding operation cannot be continued, this is not immediately notified to the CPU circuit section 900, but is notified as an alarm notification when conditions, described hereinafter, are satisfied (steps S1207 to S1210 in FIG. 16).

Next, a description will be given of a job process including the conveying operation and the escape operation after generation of an alarm in the conveying unit 300 during execution of a bookbinding job, with reference to FIGS. 16 to 18.

Figure 16:
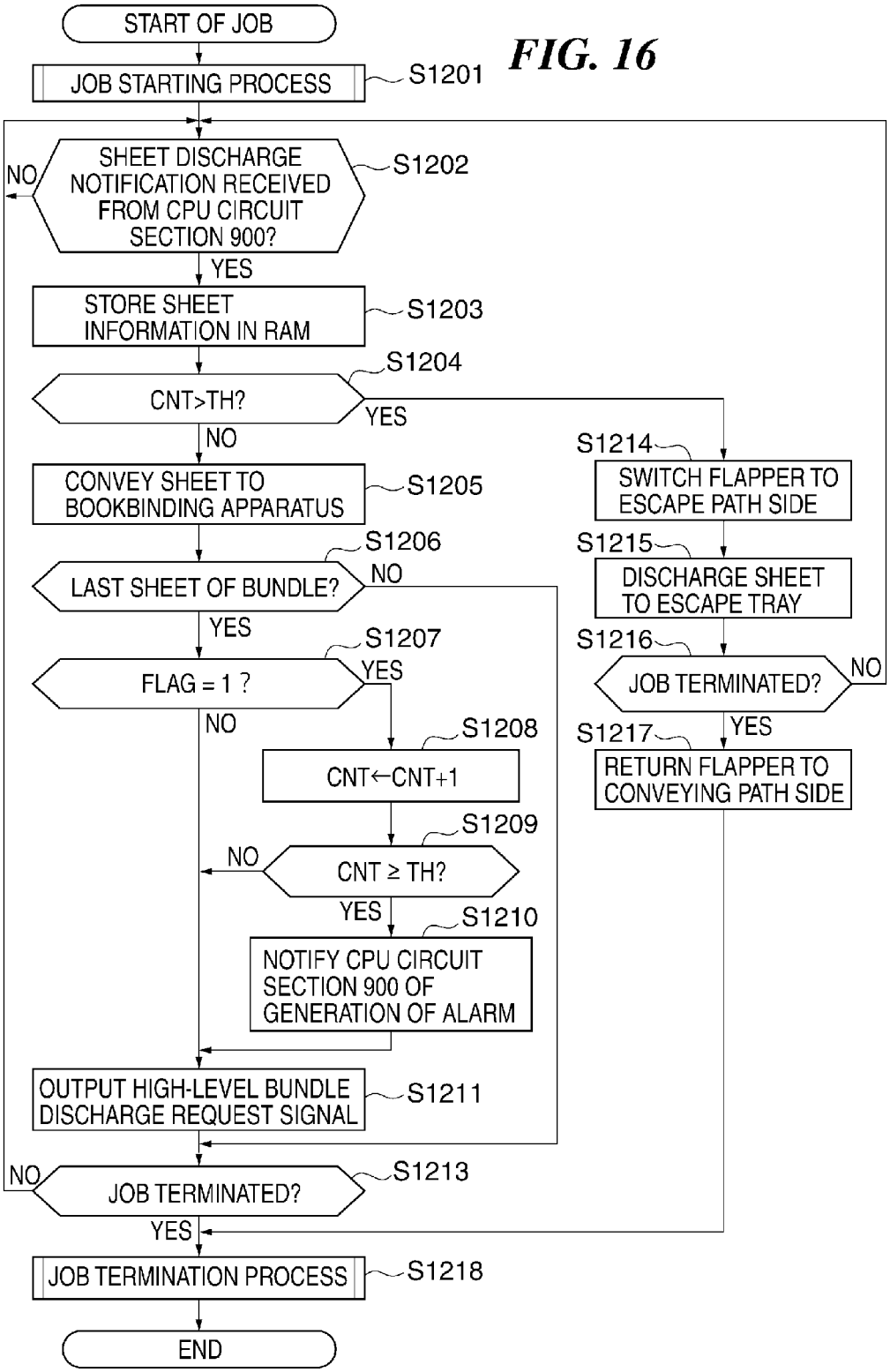
FIG. 16 is a flowchart of a job process performed by the conveying unit.

FIG. 16 is a flowchart of the job process performed by the conveying unit 300.

When a job is started, in a step S1201, the CPU circuit section 390 performs a job starting process. FIG. 17 is a flowchart of the job starting process performed in the step S1201 in FIG. 16.

Figure 17:
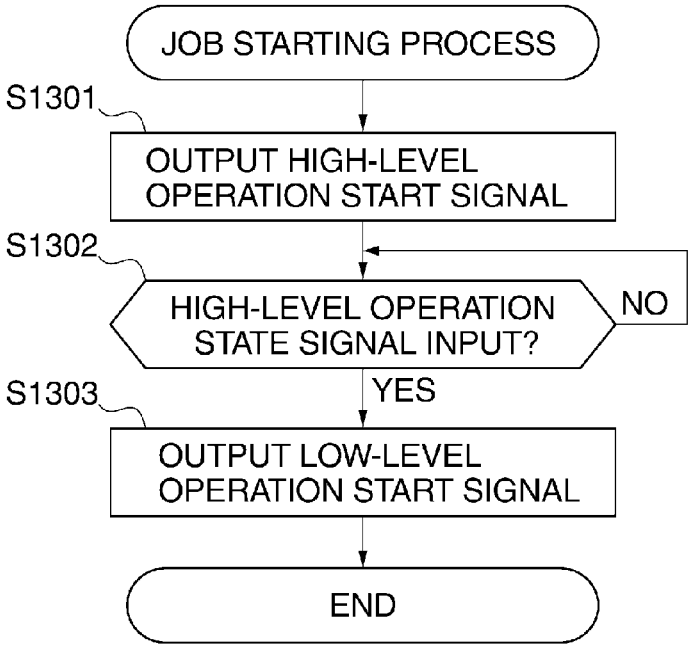
FIG. 17 is a flowchart of a job starting process performed by the conveying unit.

In a step S1301 in FIG. 17, the CPU circuit section 390 changes the output level of the operation start signal 601 of the signals exchanged with the CPU circuit section 590 via the communication interface 600 to High, to thereby notify the CPU circuit section 590 of the bookbinding apparatus 500 of the start of the job.

Next, in a step S1302, the CPU circuit section 390 monitors the operation state signal 611 which is a signal input from the CPU circuit section 590, and when the output level of the operation state signal 611 is changed to High, the CPU circuit section 390 changes the output level of the operation start signal 601 to Low in a step S1303, followed by terminating the job starting process.

When the job starting process is terminated, in a step S1202 in FIG. 16, the CPU circuit section 390 waits for a sheet discharge notification to be received from the CPU circuit section 900 of the image forming apparatus 100 via the communication interface 1000. When the image forming apparatus 100 starts to deliver a sheet to the conveying unit 300 and the CPU circuit section 390 receives the sheet discharge notification from the CPU circuit section 900, the process proceeds to a step S1203.

In the step S1203, the CPU circuit section 390 stores sheet information included in the received sheet discharge notification in the RAM 392. This sheet information includes the size, basis weight, surface characteristics, and so forth, of the sheet.

Next, in a step S1204, the CPU circuit section 390 determines whether or not the count value CNT is larger than the threshold value TH (CNT>TH). The count value CNT is a count value for counting the number of sheet bundles formed by the bookbinding apparatus 500 after the output level of the alarm signal 613 is changed to High. The step S1204 is a step for determining whether or not a predetermined number of sheet bundles have been conveyed to the bookbinding apparatus 500 after the CPU circuit section 390 has received the alarm signal 613 from the CPU circuit section 590.

If it is determined in the step S1204 that the count value CNT is not larger than the threshold value TH (CNT≤TH), the CPU circuit section 390 determines that the bookbinding apparatus 500 can further receive a sheet, and executes processing for conveying sheets to the bookbinding apparatus 500 (steps S1205 to S1211). On the other hand, if it is determined in the step S1204 that the count value CNT is larger than the threshold value TH (CNT>TH), the CPU circuit section 390 determines that the bookbinding apparatus 500 cannot receive any more sheets. In this case, the CPU circuit section 390 executes escape processing for the following sheets (steps S1214 and S1215).

In the case of execution of the steps S1205 to S1211, first, in the step S1205, the CPU circuit section 390 controls the loads (devices, such as motors, in operation) to convey the sheet S received from the image forming apparatus 100 to the bookbinding apparatus 500. That is, the CPU circuit section 390 holds the position of the flapper 320 (see FIG. 8) at the first position, and conveys out the sheets S, currently received, from the path 310 to the bookbinding apparatus 500 through the conveying path 311.

Next, in the step S1206, the CPU circuit section 390 determines whether or not the sheet S received from the image forming apparatus 100 (conveyed in the immediately preceding step S1205) is the last sheet of sheets forming one copy (one sheet bundle). Whether or not the sheet S is the last sheet of one copy can be determined using the sheet information stored in the RAM 392 in the step S1203.

If it is determined in the step S1206 that the sheet conveyed in the step S1205 is not the last sheet of one copy, the CPU circuit section 390 determines in a step S1213 whether or not the job is terminated. If it is determined in the step S1213 that the job is not terminated, the process returns to the step S1202, whereas if the job is terminated, the CPU circuit section 390 proceeds to a step S1218.

If it is determined in the step S1206 that the sheet conveyed in the step S1205 is the last sheet of one copy, the CPU circuit section 390 determines whether or not the flag FLAG is set to 1 in the step S1207.

If it is determined in the step S1207 that the flag FLAG is not equal to 1, the high-level alarm signal 613 has not been received from the CPU circuit section 590, and hence the CPU circuit section 390 can judge that the bookbinding apparatus 500 can continue the bookbinding operation. That is, the CPU circuit section 390 can judge that the bookbinding apparatus 500 can further receive a sheet. Then, the CPU circuit section 390 changes the output level of the bundle discharge request signal 604 to High to thereby request the bookbinding apparatus 500 to discharge a sheet bundle in which the sheet S passed to the bookbinding apparatus 500 is the last sheet of one copy.

On the other hand, if it is determined in the step S1207 that the flag FLAG is equal to 1, this indicates that the high-level alarm signal 613 has already been received from the CPU circuit section 590. In this case, the CPU circuit section 390 can judge that the bookbinding apparatus 500 has become incapable of continuing the bookbinding operation. Then, the CPU circuit section 390 increments the count value CNT in the step S1208 (CNT←CNT+1). The CPU circuit section 390 functions as a count unit of the present invention.

Since the count value CNT is equal to 0 when the step S1208 is executed first, the count value CNT is a value corresponding to the number of sheet bundles formed by the sheets conveyed to the bookbinding apparatus 500 after the output level of the alarm signal 613 is changed to High. Unless the state of the bookbinding apparatus 500 where the bookbinding operation cannot be continued is solved, the step S1208 is repeatedly executed whenever the last sheet of one copy is conveyed as long as CNT TH holds, and the count value CNT is counted up.

Next, in the step S1209, the CPU circuit section 390 determines whether or not CNT TH holds. If it is determined in the step S1209 that the count value CNT is smaller than the threshold value TH (CNT<TH), the CPU circuit section 390 can judge that the bookbinding apparatus 500 is in a state where the bookbinding apparatus 500 can still receive a sheet even though the bookbinding operation cannot be continued. In this case, the CPU circuit section 390 proceeds to the step S1211 without issuing an alarm notification.

On the other hand, if it is determined in the step S1209 that the count value CNT is not smaller than the threshold value TH (CNT≤TH), the CPU circuit section 390 can judge that the bookbinding apparatus 500 is in a state incapable of receiving any more sheets. Then, the CPU circuit section 390 notifies the CPU circuit section 900 of the image forming apparatus 100 of generation of an alarm via the communication interface 1000 in the step S1210. Upon receipt of this notification, in the image forming apparatus 100, the following operation for new image formation (sheet feeding and image formation) is stopped (see FIG. 14). After executing the step S1210, the process proceeds to the step S1211.

When the count value CNT exceeds the threshold value TH, CNT>TH holds when the step S1204 is executed next time, and the process proceeds to the step S1214. In the step S1214, the CPU circuit section 390 changes the position of the flapper 320 to the second position to thereby change the conveying destination of the sheet S to the escape tray 330. Then, in the step S1215, the CPU circuit section 390 controls the loads to escape the sheet S received from the image forming apparatus 100 from the path 310 to the escape tray 330 through the escape path 312.

Next, in a step S1216, the CPU circuit section 390 determines whether or not the job is terminated. If it is determined in the step S1216 that the job is not terminated, the process returns to the step S1202, whereas if the job is terminated, the process proceeds to a step S1217. Therefore, the CPU circuit section 390 repeats the steps S1202 to S1204 and the steps S1214 to S1216 until the CPU circuit section 900 terminates the job due to the alarm notification sent to the CPU circuit section 900 in the step S1210.

Then, when the job is terminated, in the step S1217, the CPU circuit section 390 changes the position of the flapper 320 to the first position to thereby return the conveying destination of the sheet S to the bookbinding apparatus 500. After execution of the step S1217, the process proceeds to a step S1218. In the step S1218, the CPU circuit section 390 executes a job termination process.

Figure 18:
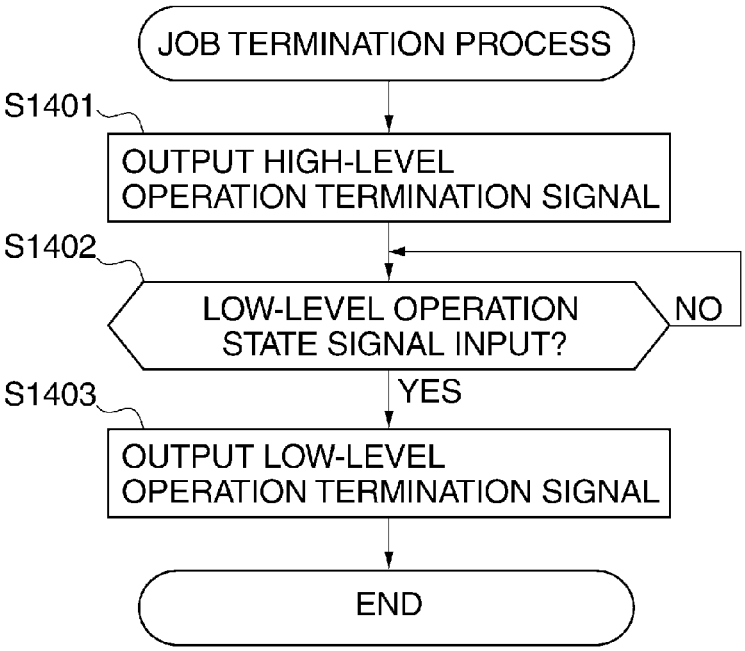
FIG. 18 is a flowchart of a job termination process performed by the conveying unit.

FIG. 18 is a flowchart of the job termination process performed in the step S1218 in FIG. 16.

In a step S1401, the CPU circuit section 390 changes the output level of the operation termination signal 602 of the signals exchanged via the communication interface 600 to High, to thereby notify the CPU circuit section 590 of the bookbinding apparatus 500 of termination of the job.

Next, in a step S1402, the CPU circuit section 390 monitors the operation state signal 611 which is a signal input from the CPU circuit section 590, and when the output level of the operation state signal 611 is changed to Low, the CPU circuit section 390 changes the output level of the operation termination signal 602 to Low in a step S1403. Then, the CPU circuit section 390 terminates the job termination process in FIG. 18.

Now, the processing operation in FIG. 16 is considered, by taking a case where the threshold value TH is set to 5, as an example.

The CPU circuit section 390 counts up the count value CNT whenever a sheet S which is the last sheet of one copy has been conveyed after it is determined that the bookbinding apparatus 500 cannot continue the bookbinding operation (steps S1206 to S1208). After the sheet S has been conveyed which is the last sheet of one copy being processed when it is determined that the bookbinding apparatus 500 cannot continue the bookbinding operation, a sheet bundle 540 to which belongs a sheet S conveyed next is set as a first sheet bundle. Therefore, a sheet S being conveyed when the count value CNT is equal to 1 is a sheet to form part of the first sheet bundle after it is determined that the bookbinding operation cannot be continued. A sheet S being conveyed when the count value CNT is equal to 5 is a sheet to form part of the fifth sheet bundle.

If it is determined in the step S1207 that the flag FLAG is equal to 1 after the last sheet of the fourth sheet bundle has been conveyed, the count value CNT is counted up to 5, and the CPU circuit section 390 notifies the CPU circuit section 900 of generation of an alarm (step S1208→S1209→S1210). If it is determined in the step S1207 that the flag FLAG is set to 1 after the last sheet of the fifth sheet bundle has been conveyed, the count value CNT is counted up to 6, and the CPU circuit section 390 notifies the CPU circuit section 900 of generation of an alarm again (step S1208→S1209→S1210).

When the count value CNT is equal to 6, the process proceeds from the step S1204 to the step S1214, and hence the first sheet S to form part of the sixth sheet bundle is discharged into the escape tray 330 (step S1204→S1214→S1215). The following sheets S are also discharged into the escape tray 330 unless the job is terminated or the count value CNT is reset.

That is, when the count value CNT counted after it is determined that the bookbinding apparatus 500 has become incapable of continuing the bookbinding operation reaches the threshold value TH, the CPU circuit section 390 sends the alarm notification for stopping the operation of image formation to the CPU circuit section 900. Further, when the count value CNT counted after it is determined that the bookbinding apparatus 500 has become incapable of continuing the bookbinding operation exceeds the threshold value TH, the CPU circuit section 390 changes the conveying destination of the sheet S which is to form part of a subsequent sheet bundle to the escape tray 330.

Figure 19:
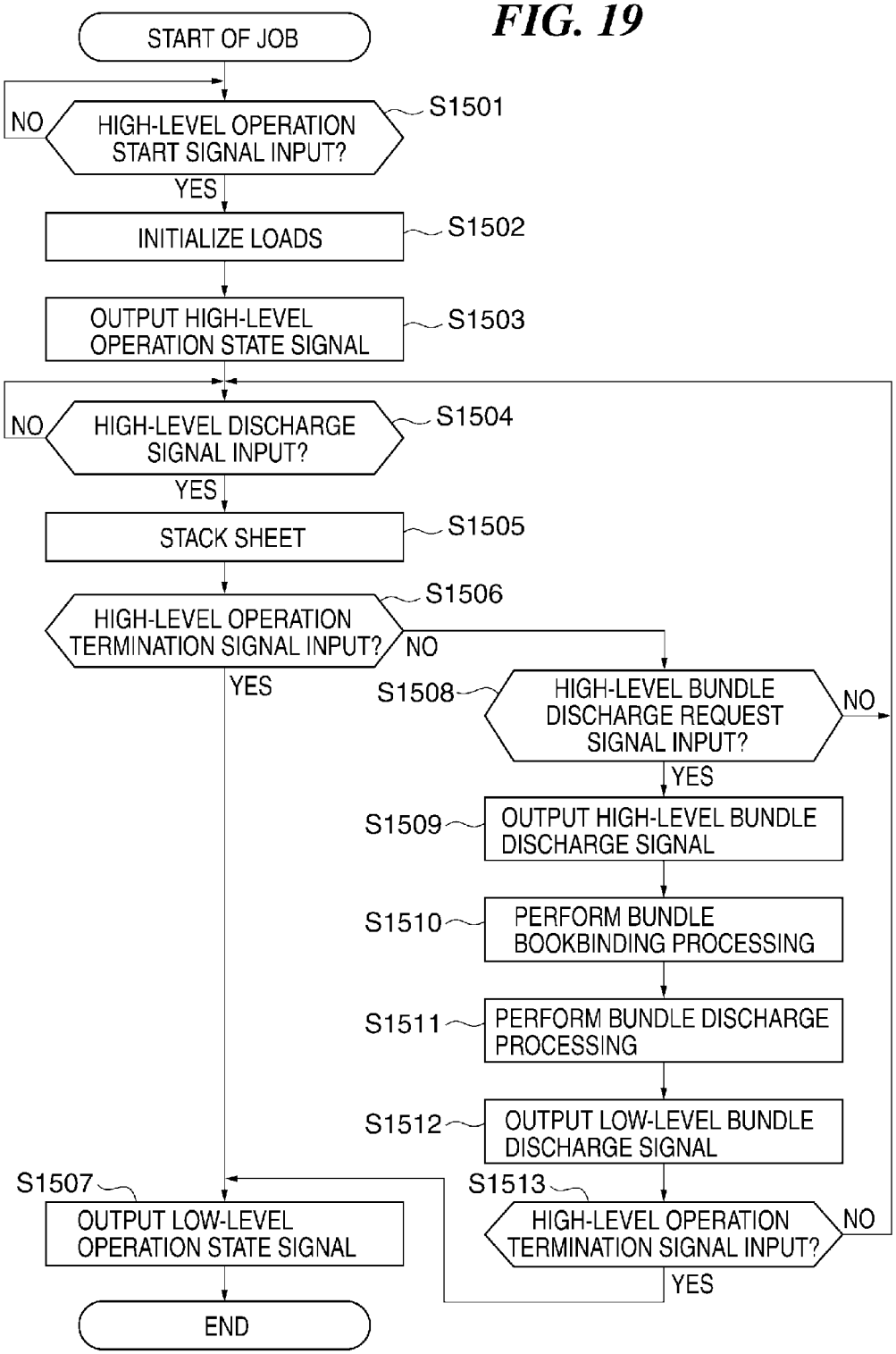
FIG. 19 is a flowchart of a bookbinding job process performed by the bookbinding apparatus.
Figure 20:
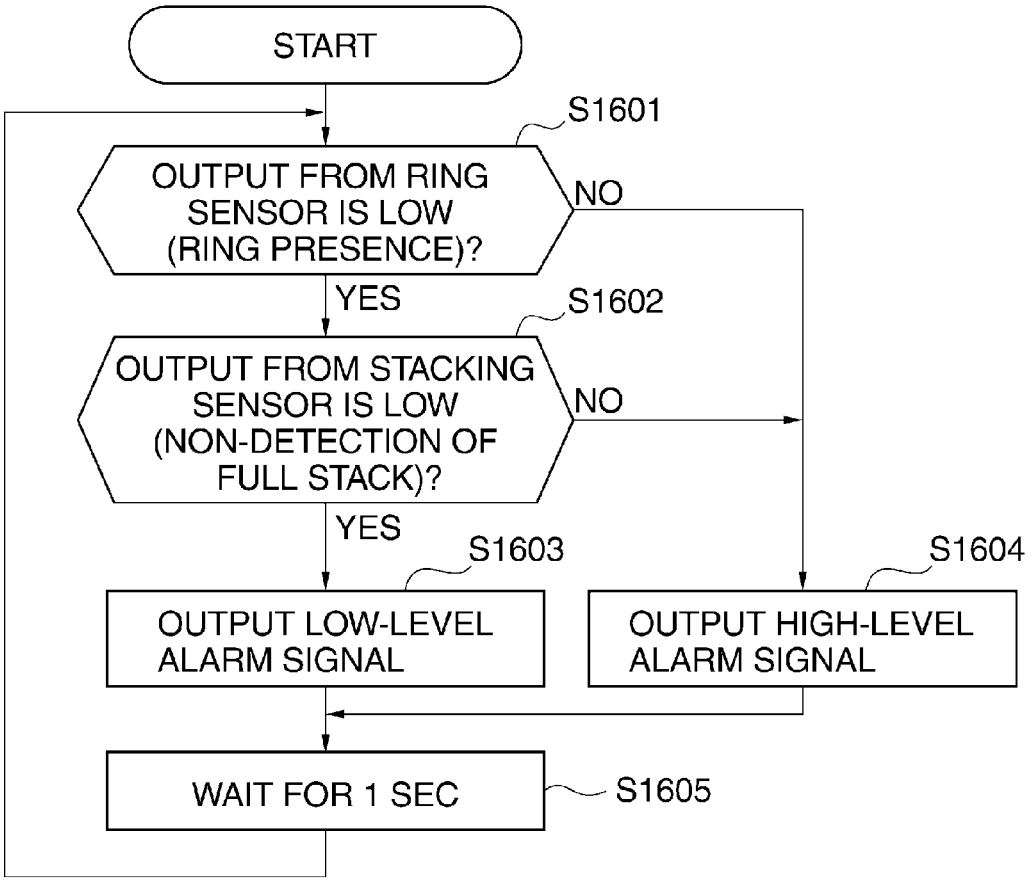
FIG. 20 is a flowchart of an alarm signal output process.

Next, the operation of the bookbinding apparatus 500 will be described with reference to FIGS. 19 and 20. FIG. 19 is a flowchart of a bookbinding job process.

The CPU circuit section 590 of the bookbinding apparatus 500 monitors the operation start signal 601 via the communication interface 600 (step S1501). Then, when the output level of the operation start signal 601 is changed to High, the CPU circuit section 590 determines that a job is started, initializes the loads in the bookbinding apparatus 500 in a step S1502, thereby causing the bookbinding apparatus 500 to shift to a state where the bookbinding operation can be executed.

Next, in a step S1503, the CPU circuit section 590 changes the output level of the operation state signal 611 to High. With this, the CPU circuit section 590 notifies the CPU circuit section 390 of completion of preparation for the bookbinding operation. In a step S1504, the CPU circuit section 590 monitors the sheet discharge signal 603. When delivery of the sheet S from the conveying unit 300 is started and the output level of the sheet discharge signal 603 is changed to High, the CPU circuit section 590 controls the loads to execute processing for stacking sheets on the stacking tray 530 (step S1505).

Next, in a step S1506, the CPU circuit section 590 determines whether or not the output level of the operation termination signal 602 of the signals exchanged via the communication interface 600 is changed to High. If it is determined in the step S1506 that the output level of the operation termination signal 602 is changed to High, the CPU circuit section 590 can judge that the job is terminated. Then, the CPU circuit section 590 changes the output level of the operation state signal 611 to Low in a step S1507 to thereby notify the CPU circuit section 390 of completion of the bookbinding operation executed by the bookbinding apparatus 500.

On the other hand, if it is determined in the step S1506 that the output level of the operation termination signal 602 is Low, the CPU circuit section 590 determines whether or not the output level of the bundle discharge request signal 604 is changed to High in a step S1508. If it is determined in the step S1508 that the output level of the bundle discharge request signal 604 is not changed to High, the process returns to the step S1504. Therefore, the steps S1504 to S1506 and S1508 are repeated, and the sheets S are sequentially stacked on the stacking tray 530 as long as the output levels of the operation termination signal 602 and the bundle discharge request signal 604 are both Low.

On the other hand, if it is determined in the step S1508 that the output level of the bundle discharge request signal 604 is changed to High, the CPU circuit section 590 changes the output level of the bundle discharge signal 612 to High to thereby notify the CPU circuit section 390 of the start of discharge of the bundle (step S1509). Then, the CPU circuit section 590 controls the loads as described above to sequentially execute processing for bookbinding the sheets S on the stacking tray 530 into a bundle (step S1510), and processing for discharging the sheet bundle 540 subjected to bookbinding processing (step S1511).

When bundle discharge processing is completed, in a step S1512, the CPU circuit section 590 changes the output level of the bundle discharge signal 612 to Low to thereby notify the CPU circuit section 390 of completion of the bundle discharging operation.

Next, in a step S1513, the CPU circuit section 590 determines whether or not the output level of the operation termination signal 602 is changed to High. If it is determined in the step S1513 that the output level of the operation termination signal 602 is not changed to High, the process returns to the step S1504. On the other hand, if it is determined in the step S1513 that the output level of the operation termination signal 602 is changed to High, the CPU circuit section 590 proceeds to the step S1507. After executing the step S1507, the process in FIG. 19 is terminated.

Next, a description will be given of the operation of the CPU circuit section 590 for changing the output level of the alarm signal 613 based on the signals output from the ring sensor 585 and the stacking sensor 586 with reference to FIG. 20. FIG. 20 is a flowchart of an alarm signal output process.

When the CPU circuit section 590 is started up, in a step S1601, the CPU circuit section 590 determines whether or not the output from the ring sensor 585 is Low (ring presence). If it is determined in the step S1601 that the output from the ring sensor 585 is Low, the CPU circuit section 590 can judge that a ring R still remains in the ring cartridge, and hence the process proceeds to a step S1602.

In the step S1602, the CPU circuit section 590 determines whether or not the output from the stacking sensor 586 is Low (non-detection of full stack). If it is determined in the step S1602 that the output from the stacking sensor 586 is Low, the CPU circuit section 590 can judge that it is possible to continue stacking of a sheet bundle 540 in the bookbound bundle-stacking box 532, and hence the process proceeds to a step S1603. In the step S1603, the CPU circuit section 590 outputs the alarm signal 613 at low level.

Next, in a step S1605, the CPU circuit section 590 waits for a predetermined period of time (e.g. one second), and then the process returns to the step S1601. Therefore, the CPU circuit section 590 repeatedly executes the steps S1601 to S1605 whenever the predetermined time period elapses after being started up.

If it is determined in the step S1601 that the output from the ring sensor 585 is High, the CPU circuit section 590 determines that the ring R has been exhausted (ring exhaustion), and hence the process proceeds to a step S1604. Also, if it is determined in the step S1602 that the output from the stacking sensor 586 is High, the CPU circuit section 590 judges that the bookbound bundle-stacking box 532 is full (full stack), and hence the process proceeds to the step S1604.

In the step S1604, the CPU circuit section 590 changes the output level of the alarm signal 613 to High to thereby notify the CPU circuit section 390 of the conveying unit 300 that the bookbinding operation cannot be continued.

Although the present embodiment shows an example of the system in which only one bookbinding apparatus 500 is connected to the conveying unit 300, the system may be configured such that a plurality of bookbinding apparatuses 500 are connected. That is, apparatuses similar to the bookbinding apparatus 500 may be connected to the conveying unit 300 in parallel using simple communication interfaces.

Figure 21A:
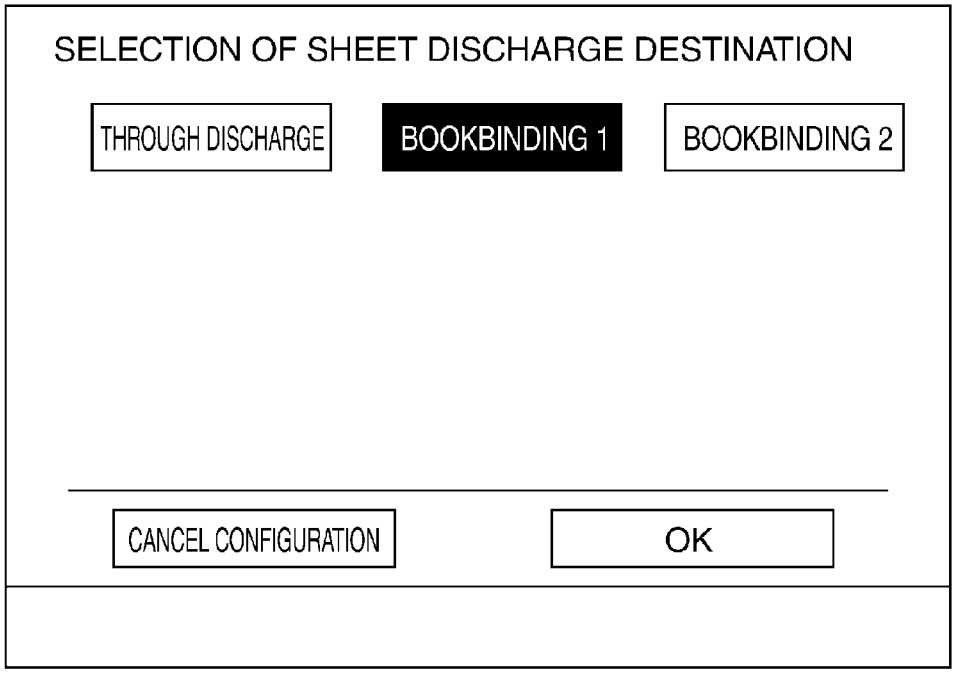
FIG. 21A is a diagram showing a finishing configuration screen in a bookbinding system to which a plurality of bookbinding apparatuses are connected.
Figure 21B:
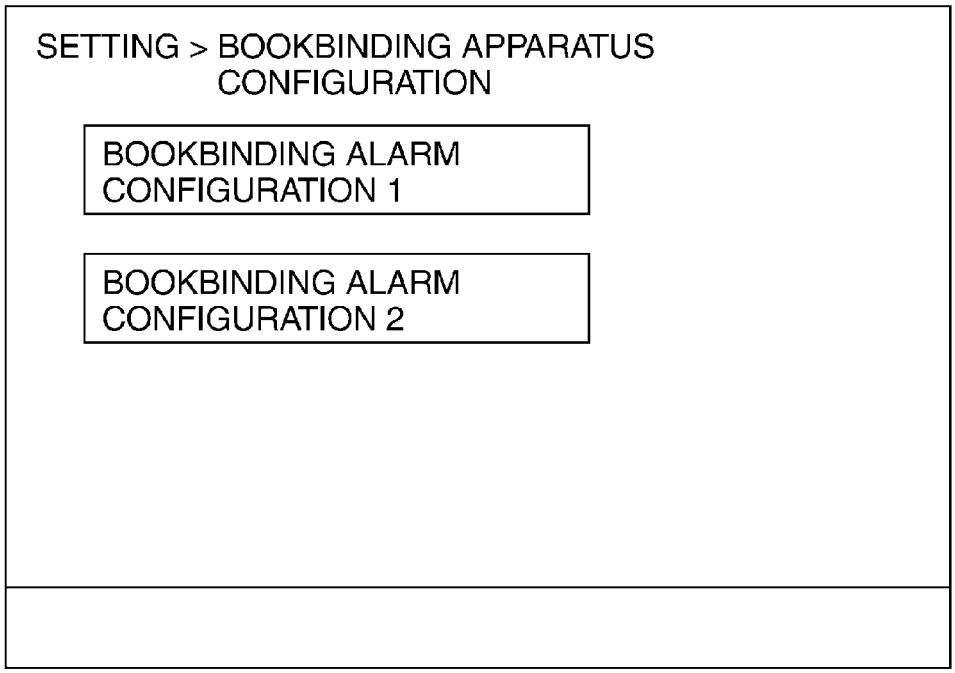
FIG. 21B is a diagram showing an example of a bookbinding configuration screen in the bookbinding system to which a plurality of bookbinding apparatuses are connected.

FIGS. 21A and 21B are diagrams showing an example of a finishing configuration screen and a bookbinding configuration screen, displayed on the display section 420 of the bookbinding system to which the plurality of bookbinding apparatuses 500 are connected.

In the case where the plurality of bookbinding apparatuses 500 are connected, for example, the user designates a discharge destination, i.e. a bookbinding apparatus to which sheets are to be discharged, on such a screen as shown in FIG. 21A.

Further, the setting of threshold value TH can be performed on the connected bookbinding apparatuses 500, on a bookbinding apparatus-by-bookbinding apparatus basis. More specifically, when an operator selects a bookbinding apparatus 500 to which the threshold value is to be set, on such a screen as shown in FIG. 21B, the above-described screens shown in FIGS. 12A to 12C are sequentially displayed. As a consequence, the threshold value TH is set individually for each bookbinding apparatus 500.

As described above, also in the case where the plurality of bookbinding apparatuses 500 are connected, by performing the same control as described above, it is possible to stop a job without causing a jam or the like when the ring exhaustion or the full stack is detected.

According to the present embodiment, when the count value CNT counted after the bookbinding apparatus 500 has become incapable of continuing the bookbinding operation exceeds the threshold value TH, the conveying destination of the sheets S forming a subsequent sheet bundle is changed to the escape tray 330. This makes it possible to restrict conveyance of sheets after the bookbinding apparatus 500 has become incapable of continuing the bookbinding operation, so as to prevent conveyance of such sheets as will cause the number of sheet bundles to exceed the threshold value TH. Therefore, it is possible to avoid the occurrence of a jam in the bookbinding apparatus 500.

Further, when the count value CNT counted after it is determined that the bookbinding operation cannot be continued reaches the threshold value TH, an alarm notification is sent to the image forming apparatus 100. Upon receipt of this notification, the image forming operation executed by the image forming apparatus 100 is immediately stopped, and hence it is possible to prevent the escape operation by the conveying unit 300 from being excessively continued.

Further, since each user can set the threshold value TH to a desired value, it is possible to set the proper threshold value TH suitable for the bookbinding apparatus 500 connected to the conveying unit 300. Therefore, it is possible to freely set the number of sheets which can be delivered to the bookbinding apparatus 500 after the bookbinding apparatus 500 has become incapable of continuing the bookbinding operation, and this increases the range from which a connectable bookbinding apparatus 500 can be selected. It can be said that practically, the threshold value TH is a value for specifying the upper limit number of sheets which can be conveyed to the bookbinding apparatus 500 after the bookbinding apparatus 500 has become incapable of continuing the bookbinding operation.

Further, the CPU circuit section 390 determines the ring exhaustion and the full stack by receiving the alarm signal 613, and hence a general-purpose simple parallel communication interface (communication interface 600) can be adopted for connection of communication between the conveying unit 300 and the bookbinding apparatus 500. Therefore, even when the non-genuine or third-party bookbinding apparatus 500 is connected to the image forming apparatus 100, it is possible to easily cope with the connection of such a bookbinding apparatus 500. Even if the bookbinding apparatus 500 is a genuine apparatus having only the above-described communication function, the above-described control can be applied.

As the threshold value TH, a default value may be set if a user does not particularly specify the threshold value.

Note that in the present embodiment, a value corresponding to the number of sheet bundles formed by the sheets which can be delivered to the bookbinding apparatus 500 after the bookbinding apparatus 500 has become incapable of continuing the bookbinding operation (referred to as the suppliable number of bundles) coincides with the threshold value TH (if TH=5, five sheet bundles). However, it is not necessarily required to make the suppliable number of bundles coincide with the threshold value TH. That is, when it is determined that the bookbinding apparatus 500 has become incapable of continuing the bookbinding operation, it is only required to control the flapper 320 such that it is switched based on a relationship between the count value CNT and the threshold value TH.

Therefore, for example, in the step S1209 and the step S1204 in FIG. 16, an object to be compared with the count value CNT may be set not to the threshold value TH, but to a value obtained by adding or subtracting a predetermined value (e.g. 1 or 2) to or from the threshold value TH.

The term "full stack" is not necessarily required to have the same meaning as "fully stacked state", but may indicate a state where the stacked amount is not smaller than a predetermined amount. Further, the term "ring exhaustion" is not necessarily required to have the same meaning as a state where there is no ring, but may indicate a state where the remaining amount of rings is not larger than a predetermined amount. Therefore, the ring sensor 585 may be configured not to detect no remaining amount of rings R, but to detect a state where the remaining amount becomes not larger than the predetermined amount. The stacking sensor 586 may be configured not to detect that the stacked amount of the sheet bundles 540 is full, but to detect that the stacked amount of the sheet bundles 540 becomes not smaller than the predetermined amount.

In the present embodiment, the bookbinding apparatus 500 has been described as an example of the post-processing apparatus, and bookbinding processing has been described as an example of the post-processing operation. However, this is not limitative, and bookbinding is not limited to ring binding, but it includes saddle-stitch bookbinding, case binding, tape binding, and so forth. Further, post-processing can include sorting, stapling, bundle discharge processing, folding, and so forth.

Although "ring exhaustion" and "full stack" have been described as examples of the factor which makes it impossible to continue the bookbinding operation, the factor is by no means limited to these. Particularly, the ring R is an example of a consumable required for the bookbinding operation, and this is not limitative. Therefore, the consumables are different depending on the configuration of the bookbinding apparatus, and the reason that makes it impossible to continue the bookbinding operation is also different.

Although the conveying unit 300 is a unit configured to only convey and escape sheets, a unit having other functions, such as a punching function, an insertion function, and a sheet stacking function, may also serve as the conveying unit 300.

Further, the number of sheets forming one copy (sheet bundle) may be one.

Further, although the conveying unit 300 and the image forming apparatus 100 are separately set and these form the image formation system, an apparatus configured to integrate the conveying unit 300 and the image forming apparatus 100 may be referred to as the image forming apparatus. For example, the conveying unit 300 may have an image forming function (or an image formation unit), or the conveying unit 300 may be configured as an image forming apparatus. In this case, the image forming apparatus as an integrated unit stops the image forming function of its own when generation of an alarm is notified (see FIG. 14).

Further, the bookbinding system is constituted by connecting the bookbinding apparatus 500 to the conveying unit 300. However, the bookbinding system (post-processing system) may be constituted by the conveying unit 300 and the bookbinding apparatus 500. In this case, the conveying unit 300 may be an image forming apparatus having the image forming function. Alternatively, the bookbinding system (post-processing system) may be constituted by the conveying unit 300, the image forming apparatus 100, and the bookbinding apparatus 500.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-092722 filed Apr. 28, 2014, which is hereby incorporated by reference herein in its entirety.

What is claimed is:

1. A sheet conveying apparatus that communicably connects a post-processing apparatus that performs post-processing on a sheet bundle formed by a plurality of sheets, comprising:

a conveying unit configured to convey a sheet via a first conveying path to the post-processing apparatus or via a second conveying path to an escape section, wherein the escape section is configured to receive the sheet conveyed by said conveying unit via the second conveying path in a case where the sheet is not conveyed to the post-processing apparatus via the first conveying path, and wherein the second conveying path is branched from the first conveying path and directed toward the escape section;

a switching unit configured to change a conveying destination of the sheet by said conveying unit to one of the post-processing apparatus and said escape section;

a counter configured to count a value corresponding to the number of sheet bundles to be formed by sheets conveyed to the post-processing apparatus; and a controller configured to determine whether or not it is impossible to continue a post-processing operation by the post-processing apparatus based on communication with the post-processing apparatus, and in a case where it is determined that it is impossible to continue the post-processing operation, control said switching unit based on the value counted by said counter.

2. The sheet conveying apparatus according to claim 1, wherein when the value counted by said counter exceeds a threshold value after it is determined that it is impossible to continue the post-processing operation, said controller controls said switching unit to change the conveying destination of sheets which form a subsequent sheet bundle to said escape section.

3. The sheet conveying apparatus according to claim 2, wherein the sheet conveying apparatus is capable of being connected to a plurality of post-processing apparatuses, and the threshold value is set on a post-processing apparatus-by-post-processing apparatus basis.

4. The sheet conveying apparatus according to claim 2, further comprising an image formation unit configured to perform image formation on each sheet before the sheet is conveyed to the post-processing apparatus, wherein when the value counted by said counter reaches the threshold value after it is determined that it is impossible to continue the post-processing operation, said controller causes said image formation unit to stop an operation for image formation.

5. The sheet conveying apparatus according to claim 2, including a setting unit configured to set the threshold value based on a manual instruction.

6. The sheet conveying apparatus according to claim 1, wherein when a remaining amount of consumables required for post-processing by the post-processing apparatus becomes not larger than a predetermined amount, said controller determines that it is impossible to continue the post-processing operation.

7. The sheet conveying apparatus according to claim 1, wherein when a stacked amount of products in a receiving section, which have been subjected to post-processing by the post-processing apparatus, becomes not smaller than a predetermined amount, said controller determines that it is impossible to continue the post-processing operation.

8. The sheet conveying apparatus according to claim 1, wherein the sheet conveying apparatus, which is connected to an image forming apparatus that supplies sheets, performs communication with the post-processing apparatus via a general-purpose parallel communication interface, and performs communication with the image forming apparatus via a communication interface which is different from the general-purpose parallel communication interface.

9. An image formation system comprising:

an image formation unit configured to perform image formation on a sheet;

a post-processing unit configured to perform post-processing on the sheet subjected to the image formation by said image formation unit;

a conveying unit configured to convey a sheet via a first conveying path from said image forming unit to said post-processing unit or via a second conveying path from said image forming unit to an escape section, wherein the escape section is configured to receive the sheet subjected to image formation by said image formation unit via the second conveying path in a case where the sheet is not conveyed to said post-processing unit via the first conveying path, and wherein the second conveying path is branched from the first conveying path and directed toward the escape section;

a switching unit configured to change a conveying destination of the sheet to one of said post-processing apparatus and said escape section;

a determination unit configured to determine whether or not it is impossible to continue a post-processing operation by said post-processing unit;

a counter configured to count a value corresponding to the number of sheet bundles to be formed by sheets conveyed to said post-processing unit; and a controller configured to, in a case where it is determined by said determination unit that it is impossible to continue the post-processing operation by said post-processing unit, control said switching unit based on the value counted by said counter.

10. The image formation system according to claim 9, wherein when the value counted by said counter exceeds a threshold value after it is determined by said determination unit that it is impossible to continue the post-processing operation, said controller controls said switching unit to change the conveying destination of sheets which form a subsequent sheet bundle to said escape section, and causes said image formation unit to stop an operation for image formation.

11. The image formation system according to claim 10, further comprising a setting section configured to perform manual setting of the threshold value.

12. A post-processing system that performs post-processing on a sheet conveyed from an external apparatus, comprising:

a post-processing unit configured to perform post-processing on the sheet conveyed from the external apparatus;

a conveying unit configured to convey a sheet via a first conveying path from the external apparatus to the post-processing unit or via a second conveying path from the external apparatus to an escape section, wherein the escape section is configured to receive the sheet conveyed by said conveying unit via the second conveying path in a case where the sheet is not conveyed to said post-processing unit via the first conveying path, and wherein the second conveying path is branched from the first conveying path and directed toward the escape section;

a switching unit configured to change a conveying destination of the sheet conveyed by said conveying unit to one of the post-processing apparatus and said escape section;

a determination unit configured to determine whether or not it is impossible to continue a post-processing operation by said post-processing apparatus;

a counter configured to count a value corresponding to the number of sheet bundles to be formed by sheets conveyed to the post-processing apparatus; and a controller configured to, in a case where it is determined by said determination unit that it is impossible to continue the post-processing operation, control said switching unit based on the value counted by said counter.

13. An image forming apparatus to which a post-processing apparatus that performs post-processing on a sheet bundle formed by a plurality of sheets is communicably connected, comprising:

an image formation unit configured to perform image formation on a sheet;

a conveying unit configured to convey a sheet subjected to the image formation by said image formation unit via a first conveying path from the image forming unit to the post-processing apparatus or via a second conveying path from the image forming unit to an escape section, wherein the escape section is configured to receive the sheet subjected to image formation by said image formation unit via the second conveying path in a case where the sheet is not conveyed to the post-processing apparatus via the first conveying path, and wherein the second conveying path is branched from the first conveying path and directed toward the escape section;

a determination unit configured to determine whether or not it is impossible to continue a post-processing operation by the post-processing apparatus;

a setting unit configured to preliminarily manually set a threshold value for specifying an upper limit value of sheets which can be conveyed to the post-processing apparatus after it is determined by said determination unit that it is impossible to continue the post-processing operation by the post-processing apparatus; and a controller configured to, in a case where it is determined by said determination unit that it is impossible to continue the post-processing operation by the post-processing apparatus, control said conveying unit based on the threshold value set by said setting unit.

14. The image forming apparatus according to claim 13, comprising a counter configured to count a value corresponding to the number of sheet bundles to be formed by sheets conveyed to the post-processing apparatus, and wherein when the value counted by said counter exceeds a threshold value after it is determined by said determination unit that it is impossible to continue the post-processing operation, said controller controls said conveying unit to cause the sheet to be received in the escape section.

15. The image forming apparatus according to claim 13, wherein in a case where it is determined by said determination unit that it is impossible to continue the post-processing operation, said controller controls said image formation unit to interrupt image formation.

* * * * *